US010608352B2

(12) United States Patent
Hirata

(10) Patent No.: US 10,608,352 B2
(45) Date of Patent: Mar. 31, 2020

(54) CONNECTOR AND CONNECTOR ASSEMBLY

(71) Applicant: Molex, LLC, Lisle, IL (US)

(72) Inventor: Seishiro Hirata, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/226,853

(22) Filed: Dec. 20, 2018

(65) Prior Publication Data

US 2019/0199012 A1 Jun. 27, 2019

(30) Foreign Application Priority Data

| | | |
|---|---|---|
| Dec. 21, 2017 | (JP) | 2017-245004 |
| May 30, 2018 | (JP) | 2018-102973 |
| May 30, 2018 | (JP) | 2018-103071 |
| May 30, 2018 | (JP) | 2018-103195 |
| May 30, 2018 | (JP) | 2018-103298 |

(51) Int. Cl.

| | |
|---|---|
| ***H01R 9/05*** | (2006.01) |
| ***H01R 13/20*** | (2006.01) |
| ***H01R 13/52*** | (2006.01) |
| ***H01R 13/62*** | (2006.01) |
| ***H01R 24/40*** | (2011.01) |
| ***H01R 103/00*** | (2006.01) |
| ***H01R 13/405*** | (2006.01) |
| ***H01R 11/05*** | (2006.01) |

(52) U.S. Cl.

CPC ..... *H01R 9/05* (2013.01); *H01R 13/20* (2013.01); *H01R 13/521* (2013.01); *H01R 13/5205* (2013.01); *H01R 13/62* (2013.01); *H01R 24/40* (2013.01); *H01R 11/05* (2013.01); *H01R 13/405* (2013.01); *H01R 2103/00* (2013.01)

(58) Field of Classification Search

CPC ..... H01R 2103/00; H01R 24/40; H01R 24/56–24/60

USPC ..... 439/578, 580

See application file for complete search history.

(56) References Cited

U.S. PATENT DOCUMENTS

| | | | | | |
|---|---|---|---|---|---|
| 4,596,435 | A * | 6/1986 | Bickford | H01R 24/542 | 439/578 |
| 6,309,251 | B1 * | 10/2001 | Tang | H01R 9/05 | 439/263 |
| 6,352,448 | B1 * | 3/2002 | Holliday | H01R 9/0521 | 439/585 |
| 8,414,327 | B2 * | 4/2013 | Mana | H01R 13/533 | 439/578 |
| 2012/0295476 | A1 * | 11/2012 | Holland | H01R 13/11 | 439/578 |

FOREIGN PATENT DOCUMENTS

| | | |
|---|---|---|
| CN | 1692532 A | 11/2005 |
| CN | 2739837 Y | 11/2005 |
| CN | 1705169 A | 12/2005 |
| JP | H6-41082 U | 5/1994 |
| TW | M248049 U | 10/2004 |
| TW | I459655 B | 11/2014 |

* cited by examiner

*Primary Examiner* — Gary F Paumen

(74) *Attorney, Agent, or Firm* — Molex, LLC

(57) ABSTRACT

A connector is provided that has high waterproof property and insertion/extraction performance, and increased reliability while being small in size.

19 Claims, 19 Drawing Sheets

FIG. 10A
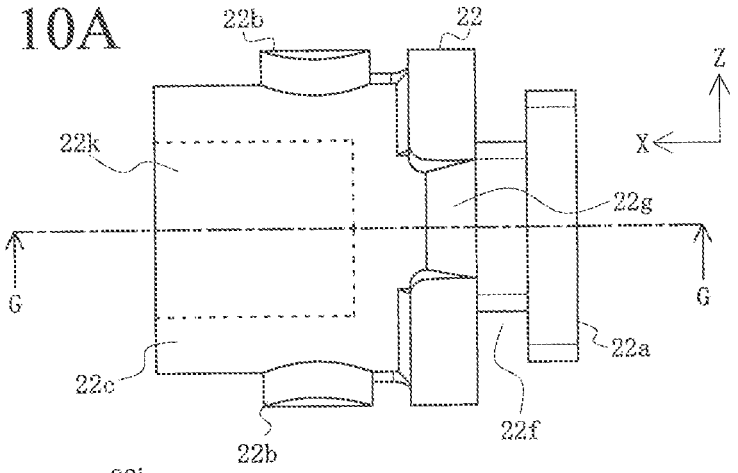
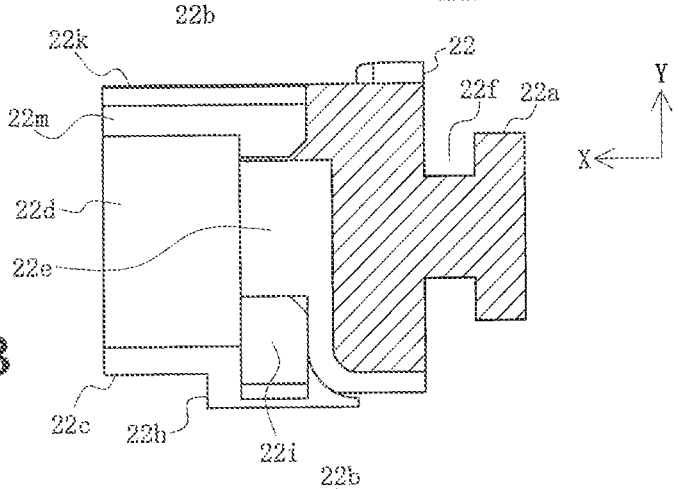
FIG. 10B
FIG. 10C
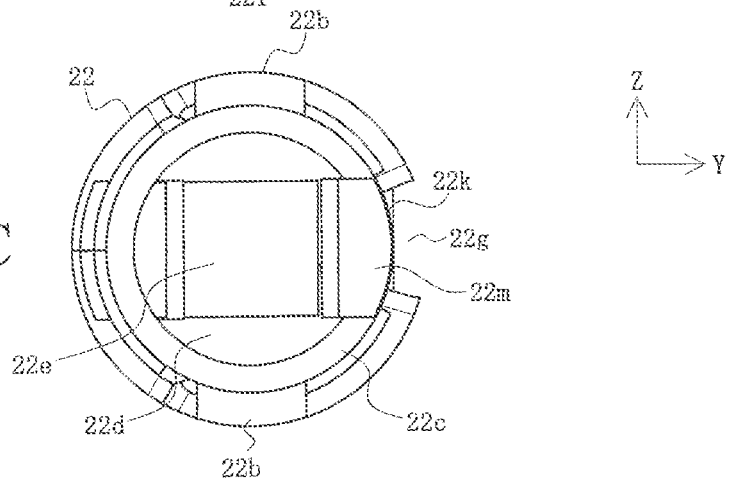

FIG. 15A
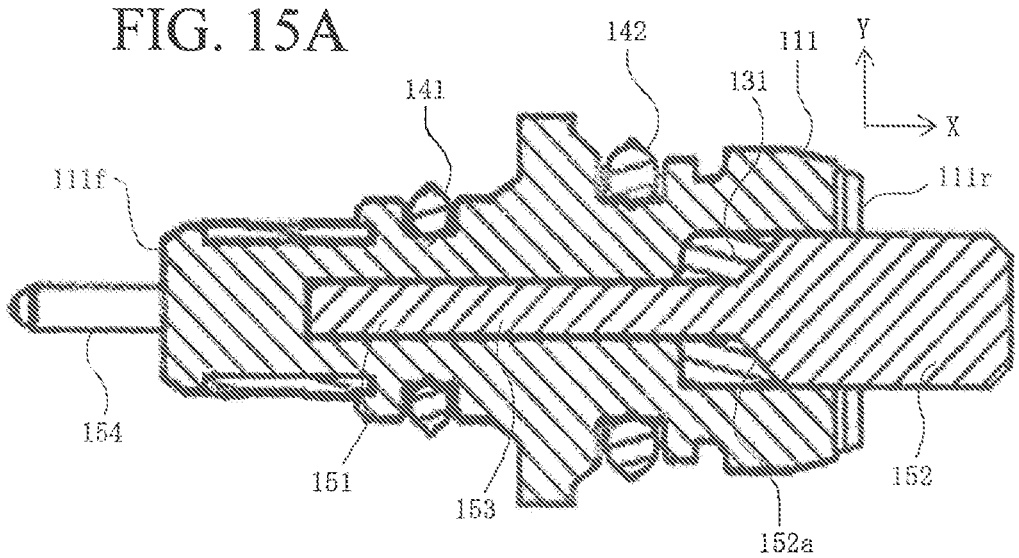
FIG. 15B
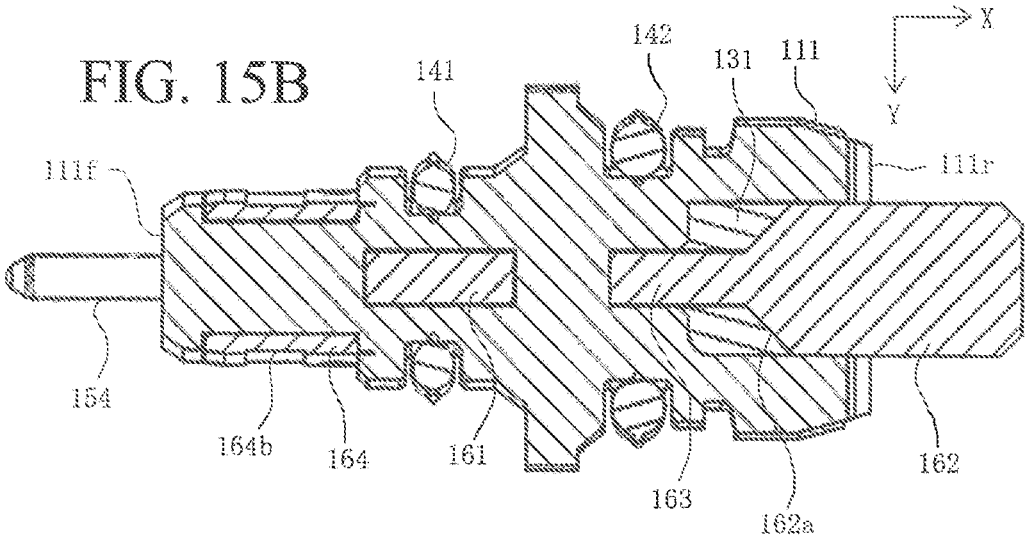
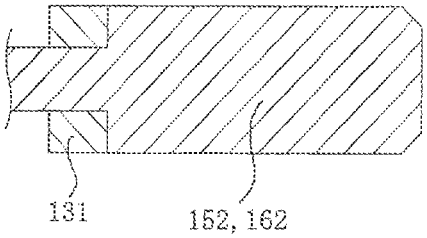
FIG. 15C
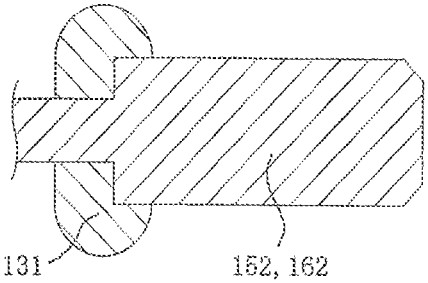
FIG. 15D

FIG. 16A
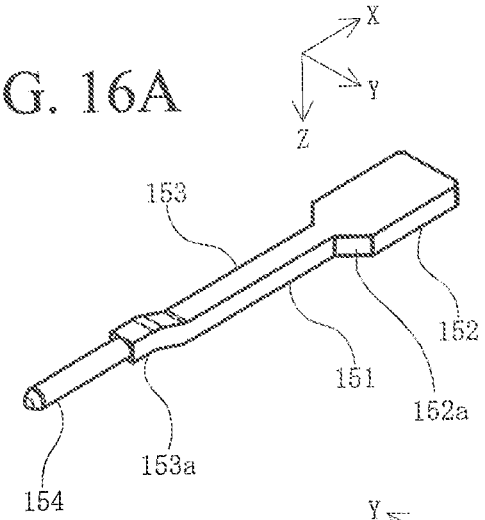
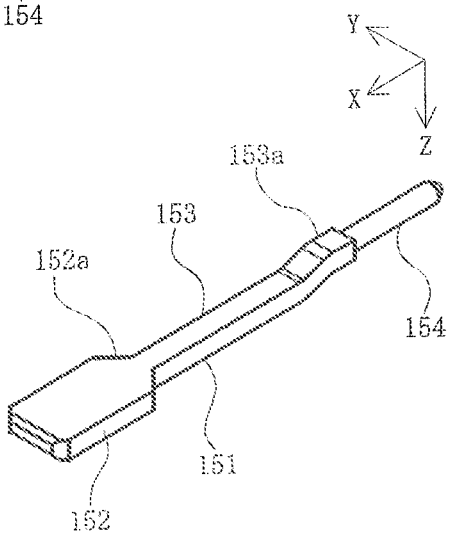
FIG. 16B

CONNECTOR AND CONNECTOR ASSEMBLY

RELATED APPLICATIONS

This application claims priority to Japanese Application No. 2017-245004, filed Dec. 21, 2017, Japanese Application No. 2018-102973, filed May 30, 2018, Japanese Application No. 2018-103071, filed May 30, 2018, Japanese Application No. 2018-103195, filed May 30, 2018 and Japanese Application No. 2018-103298, filed May 30, 2018, all of which are incorporated herein by reference in their entireties.

TECHNICAL FIELD

The present disclosure relates to a connector and a connector assembly.

BACKGROUND ART

Conventionally, a connector, in which a circumference of a terminal is surrounded by a cylindrical shell, is connected to a tip of a cable, such as a coaxial cable, in order to connect the cable to a receptacle or the like included in an electric part, an electronic part, and the like (for example, see Patent Literature 1).

FIG. 19 is a cross-sectional view of the conventional connector.

In FIG. 19, reference numeral 861 denotes a cylindrical shell of a connector connected to a tip of a coaxial cable 891, and a small cylindrical shield cover portion 863 extending from a rear part of the coaxial cable 891 sandwiches an end of the coaxial cable 891 and is connected to a shielded wire 892 of the coaxial cable 891. A circumference of the shell 861 is covered with a cover 811 made of an insulating resin.

In addition, reference numeral 851 denotes a terminal disposed inside the shell 861. A tail portion 852 extending from a rear portion of the shell 861 is connected to a central conductor 894 protruding from the tip of the coaxial cable 891 by a connecting means such as soldering. An insulating member 821 surrounding the circumference of the terminal 851 is fixed inside the shell 861.

If the connector having such a configuration is fitted into a mating connector, a mating terminal 951 is inserted into the terminal 851 to be electrically connected to the terminal 851, and a mating shell 961 is inserted into the shell 861 to be electrically connected to the shell 861.

Patent Literature 1: Japan UM. Appln. KOKAI Publication No. 06-041082

SUMMARY

However, in the conventional connector, waterproof property is not sufficient, and therefore moisture is likely to infiltrate into the coaxial cable 891 from a tip part of the connector. In addition, it is also conceivable to attach a waterproof member to the tip part of the connector, but in that case, as a size of the connector increases, performance of fitting and unfitting into and from the mating connector, that is, insertion/extraction performance deteriorates.

Here, the present disclose has been made the problems of the conventional connector, and an object of the present disclosure is to provide a highly reliable connector which is small in size and has high waterproof property and insertion and extraction performance and a connector assembly by solving the problems of the conventional connector.

To achieve the above problem, a connector includes: an outer conductor portion which includes a hollow outer body portion and an opening penetrating through a side wall of the outer body portion; an intermediate insulator which is made of an insulating material and housed in the outer body portion, and includes an internal cavity formed in the intermediate insulator and a recessed portion further recessed than an outer circumferential surface of the intermediate insulator; a central conductor portion which includes a central body portion housed in the internal cavity and a contact arm portion extending forward from the central body portion and housed in the internal cavity; and a cap which is made of an insulating material and integrally attached to a rear end of the outer body portion and a rear end of the central body portion, wherein the cap includes a protruding portion entering an opening of the outer conductor portion and a cylindrical portion entering the recessed portion of the intermediate insulator positioned at the internal cavity of the outer body portion.

In another embodiment, the connector further includes a seal member which is made of an elastomer and integrally attached to a rear end of the cap and a front sleeve which is made of an insulating material and integrally attached to an outer side of the outer body portion, wherein the seal member is formed such that a front side of the seal member overlaps a rear end on an outer circumferential surface of the front sleeve and a vicinity of a rear end of the front sleeve.

In still another embodiment, in the connector, the cap is formed with an anchor portion having a constricted portion provided behind the cap, and the seal member is formed such that a rear side of the seal member covers a circumference of each member in a range up to the at least anchor portion.

In still another embodiment, in the connector, the outer conductor portion includes an outer tail portion extending rearward from the outer body portion, the central conductor portion includes a central tail portion extending rearward from the central body portion, a cable is connected to the outer tail portion and the central tail portion, and the seal member is formed so as to cover the circumference of each member without a gap in a range up to a portion close to a front end on an outer circumferential surface of an inner covering member of an electric wire of the cable.

In still another embodiment, in the connector, the outer tail portion includes a first connection plate and a second connection plate which are orthogonal to each other as viewed from a front-rear direction and are each connected to two locations on a circumferential surface of a second core wire of a cable extending in the front-rear direction, the central tail portion includes a first connection plate and a second connection plate which are orthogonal to each other as viewed from a front-rear direction and are each connected to two locations on a circumferential surface of a first core wire of the cable extending in the front-rear direction, the first connection plate of the outer tail portion and the first connection plate of the central tail portion face each other, and the second connection plate of the outer tail portion and the second connection plate of the central tail portion are disposed so as to be substantially flush with each other.

In addition, a connector includes: an outer conductor portion which includes a hollow outer body portion; an intermediate insulator which is made of an insulating material and housed in the outer body portion, and includes an internal cavity formed in the intermediate insulator; a central conductor portion which includes a central body portion housed in the internal cavity and a contact arm portion extending forward from the central body portion and housed in the internal cavity; a cap which is made of an insulating material and integrally attached to a rear end of the outer body portion and a rear end of the central body portion; a seal member which is made of an elastomer and integrally attached to a rear end of the cap; and a rear sleeve which is made of an insulating material and integrally attached to an outer side of the seal member.

In another embodiment, in the connector, the outer conductor portion includes an outer tail portion extending rearward from the outer body portion, the central conductor portion includes a central tail portion extending rearward from the central body portion, an electric wire of a cable is connected to the outer tail portion and the central tail portion, the electric wire is covered with an outer covering member, and the rear sleeve includes a gate trace which is positioned in front of a front end of the outer covering member and formed at a position corresponding to a gate through which an insulating material of the rear sleeve flows into a molding mold.

In still another embodiment, in the connector, the rear sleeve includes a recessed portion existing over a whole circumference of an outer surface in front of the gate trace.

In still another embodiment, in the connector, the rear sleeve includes an overflow trace which is positioned near a rear end on an outer surface of the rear sleeve and is formed at a position at which the insulating material of the rear sleeve is discharged from an inside of the molding mold by an overflow.

In still another embodiment, in the connector, the connector further includes: a front sleeve which is made of an insulating material and integrally attached to an outer side of the outer body portion in front of the rear sleeve.

To achieve the above problem, a connector includes: an outer conductor portion which includes a hollow outer body portion, a seam formed in the outer body portion and extending in a front-rear direction, and a slit extending in a circumferential direction to be caught in the seam; an intermediate insulator which is made of an insulating material, has at least a part thereof behind the slit housed in the outer body portion, and includes an internal cavity formed in the intermediate insulator; and a central conductor portion which includes a central body portion housed in the internal cavity and a contact arm portion extending forward from the central body portion and housed in the internal cavity.

In the connector, the intermediate insulator is fixed to the outer conductor portion behind the slit.

The connector further includes: a front sleeve which is made of an insulating material, is integrally attached to an outside of the outer body portion, and has a part thereof entering into the slit.

The connector further includes: a cap which is made of an insulating material and integrally attached to a rear end of the outer body portion and a rear end of the central body portion, in which the outer conductor portion includes an opening penetrating through a side wall of the outer body portion, the intermediate insulator includes a recessed portion recessed from an outer circumferential surface thereof, and the cap includes a protruding portion entering the opening of the outer conductor portion and a cylindrical portion entering between the outer body portion and the recessed portion of the intermediate insulator.

To achieve the above problem, a mating connector includes: a mating housing which is made of an insulating material; a mating outer conductor portion which includes a main body portion buried into the mating housing and a contact portion connected to the main body portion and having at least a part of an outer circumferential surface exposed from the mating housing; and a mating central conductor portion which includes a main body portion buried into the mating housing and is connected to the main body portion and has at least a tip thereof protruding forward from a housing front end of the mating housing, in which the main body portion of the mating outer conductor portion includes a curved portion having a substantially crank-like side surface shape.

In another embodiment, the mating connector further includes: a mating seal member which is made of an insulating material, in which the mating outer conductor portion includes a tail portion extending rearward from the main body portion, the mating central conductor portion includes a tail portion extending rearward from the main body portion, and the mating seal member is integrally molded within the mating housing to surround a circumference of a connection portion between the main body portion and the tail portion of the mating outer conductor portion and a circumference of a connection portion between the main body portion and the tail portion of the mating central conductor portion.

In still another embodiment, the mating connector, an inclined portion shifted to the main body portion having a narrow width is formed on both sides in a width direction at a front end of the tail portion as the connection portion of the mating outer conductor portion, an inclined portion shifted to the main body portion having a narrow width is formed on both sides in a width direction at a front end of the tail portion as the connection portion of the mating central conductor portion, and the seal member is integrally formed to surround a circumference of the inclined portion.

In still another embodiment, the mating connector, the main body portion of the mating outer conductor portion and the main body portion of the mating central conductor portion are formed in a plate shape and are disposed in parallel with each other, and a thickness of the main body portion of the mating outer conductor portion is thinner than that of the main body portion of the mating central conductor portion.

The connector assembly includes the connector of the present disclosure, and a mating connector which includes a mating outer conductor portion connected to the outer conductor portion and a mating central conductor portion connected to the central conductor portion.

According to the present disclosure, the connector is small in size, and has high waterproof property, insertion/extraction performance, and reliability.

BRIEF DESCRIPTION OF THE DRAWINGS

FIGS. 3A and 3B are two-side views of the connector according to the present embodiment, in which FIG. 3A is a side view and FIG. 3B is a bottom view.

FIGS. 4A-4C are cross-sectional views of the connector according to the present embodiment, in which FIG. 4A is a cross-sectional view taken along the arrow A-A in FIG. 3A, FIG. 4B is a cross-sectional view taken along the arrow B-B in FIG. 3B, and FIG. 4C is a cross-sectional view taken along the arrow C-C in FIG. 3A.

FIGS. 5A-5D are four-side views of a shell according to the present embodiment, in which FIG. 5A is a perspective view, FIG. 5B is a top view, FIG. 5C is a side view, and FIG. 5D is a cross-sectional view taken along the arrow D-D of FIG. 5C.

FIGS. 6A-6D are four-side views of an intermediate insulator according to the present embodiment, in which FIG. 6A is a perspective view, FIG. 6B is a top view, FIG. 6C is a side view, and FIG. 6D is a cross-sectional view taken along the arrow E-E of FIG. 6C.

FIG. 7A is a perspective view as viewed from the front, FIG. 7B is a perspective view as viewed from the rear, and FIG. 7C is a bottom view.

FIGS. 8A and 8B are partial assembling perspective views of the connector according to the present embodiment, in which FIG. 8A is a perspective view as viewed from the front and FIG. 8B is a perspective view as viewed from the rear.

FIGS. 9A-9C are first three-side views of a cap according to the present embodiment, in which FIG. 9A is a top view, FIG. 9B is a cross-sectional view taken along the arrow F-F in FIG. 9A, and FIG. 9C is a perspective view as viewed from the front.

FIGS. 10A-10C are second three-side views of the cap according to the present embodiment, in which FIG. 10A is a side view, FIG. 10B is a cross-sectional view taken along the arrow G-G in FIG. 10A, and FIG. 10C is a front view.

FIGS. 11A and 11B are partial assembling two-side views of the connector according to the present embodiment, in which FIG. 11A is a top view and FIG. 11B is a cross-sectional view taken along the arrow H-H in FIG. 11A.

FIGS. 12A and 12B are perspective views of a mating connector according to the present embodiment, in which FIG. 12A is a perspective view as viewed from the rear and FIG. 12B is a perspective view as viewed from the front.

FIGS. 13A and 13B are first two-side views of the mating connector according to the present embodiment, in which FIG. 13A is a top view and FIG. 13B is a cross-sectional view taken along the arrow I-I in FIG. 13A.

FIGS. 14A and 14B are second two-side views of the mating connector according to the present embodiment, in which FIG. 14A is a side view and FIG. 14B is a cross-sectional view taken along the arrow J-J in FIG. 14A.

FIGS. 15A-15D are longitudinal cross-sectional views of the mating connector according to the present embodiment, in which FIG. 15A is a cross-sectional view taken along the arrow K-K in FIG. 14B, FIG. 15B is a cross-sectional view taken along the arrow L-L in FIG. 14B, and FIGS. 15C and 15D are partial modification examples of FIGS. 15A and 15B.

FIGS. 16A and 16B are two-side views of the mating terminal according to the present embodiment, in which FIG. 16A is a perspective view as viewed from the front and FIG. 16B is a perspective view as viewed from the rear.

FIGS. 17A and 17B are two-side views of a mating shell according to the present embodiment, in which FIG. 17A is a perspective view as viewed from the front and FIG. 17B is a side view.

FIGS. 18A and 18B are two-side views showing a state in which the connector and the mating connector according to the present embodiment are fitted into each other, in which FIG. 18A is a top view and FIG. 18B is a cross-sectional view taken along the arrow M-M in FIG. 18A.

DETAILED DESCRIPTION OF THE PREFERRED EMBODIMENTS

Hereinafter, embodiments will be described in detail with reference to the accompanying drawings.

Figure 1:
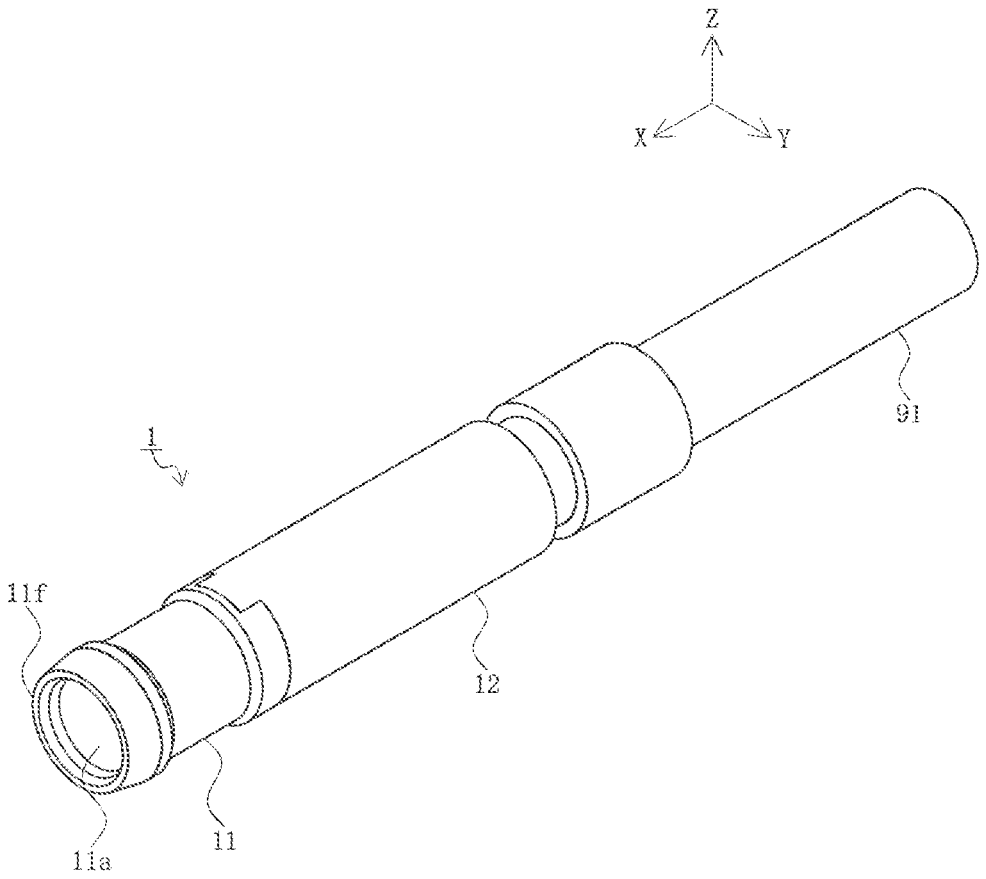
FIG. 1 is a perspective view of a connector according to the present embodiment.
Figure 2:
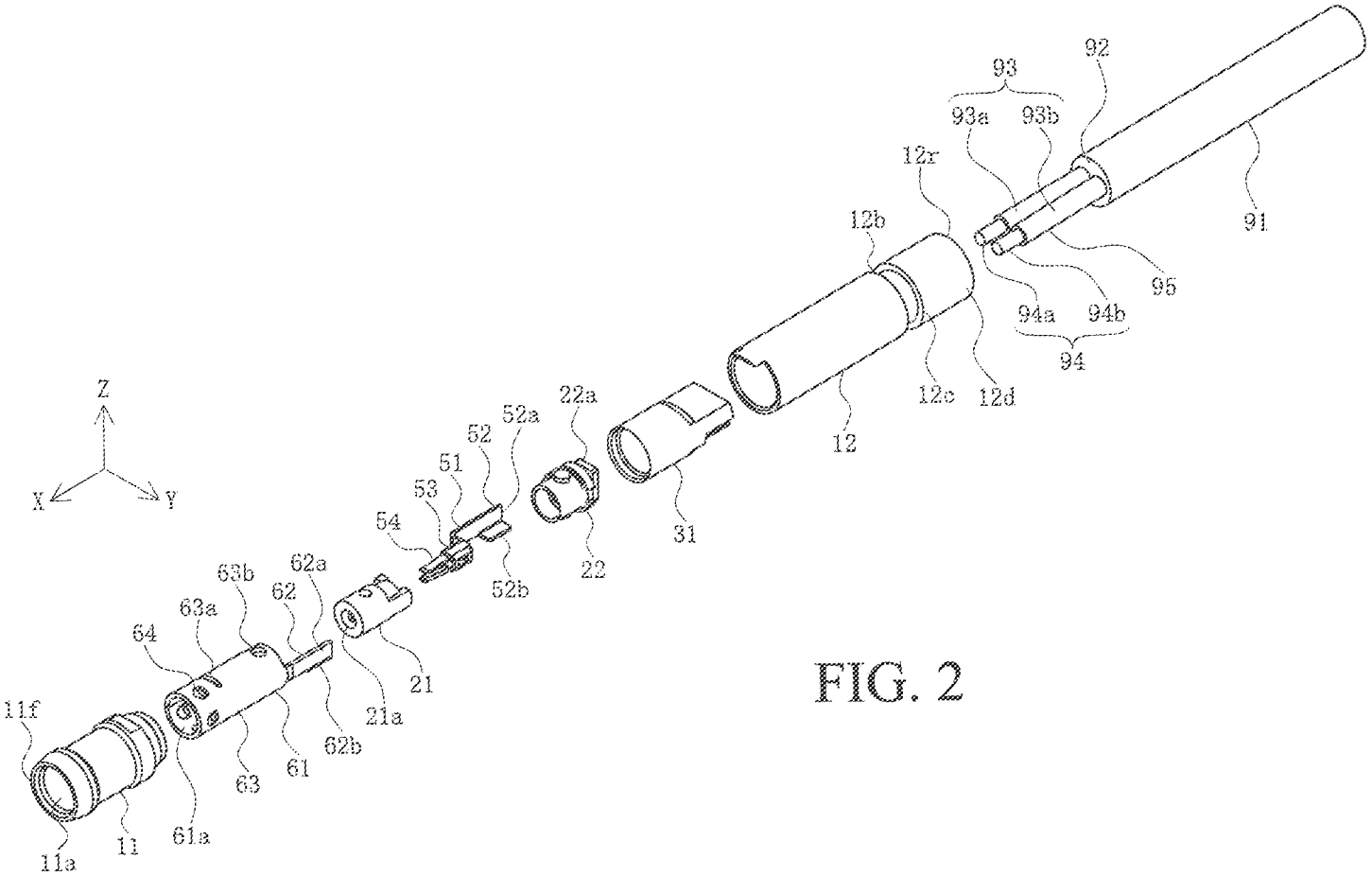
FIG. 2 is an exploded view of the connector according to the present embodiment.
Figure 3A:
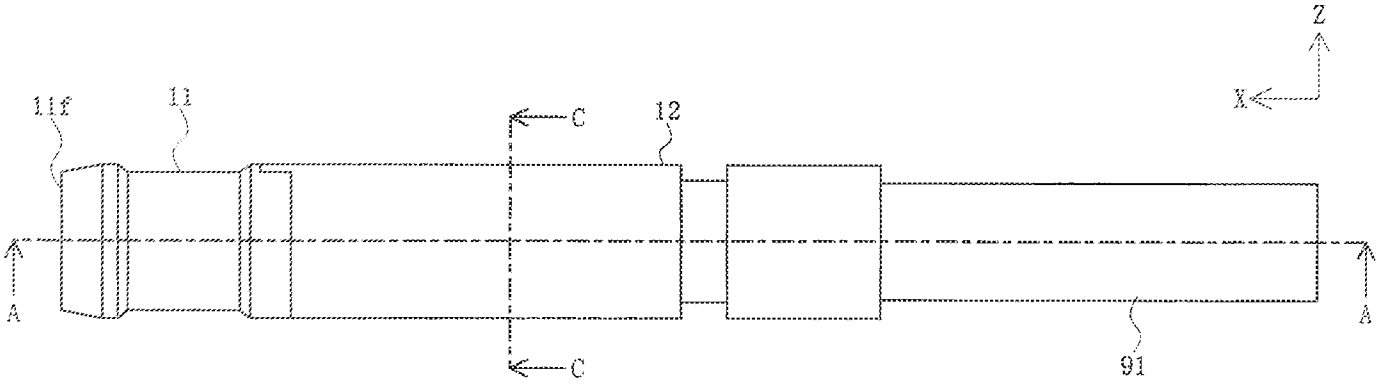
Figure 3B:
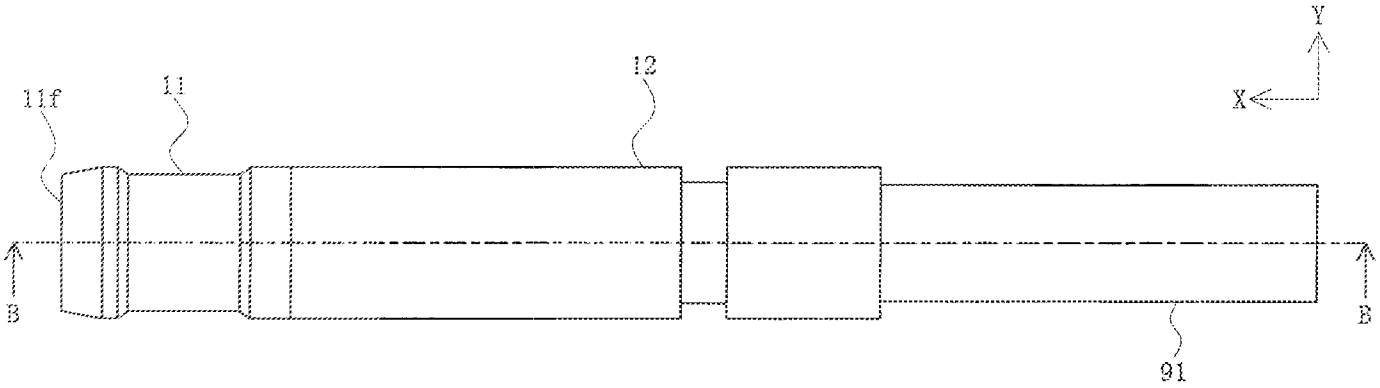
Figure 4A:
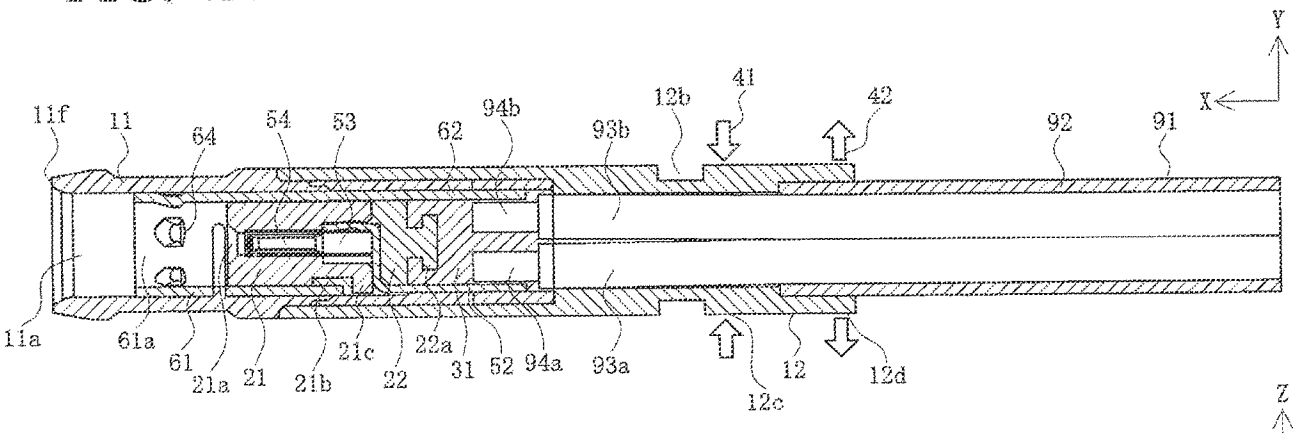
Figure 4B:
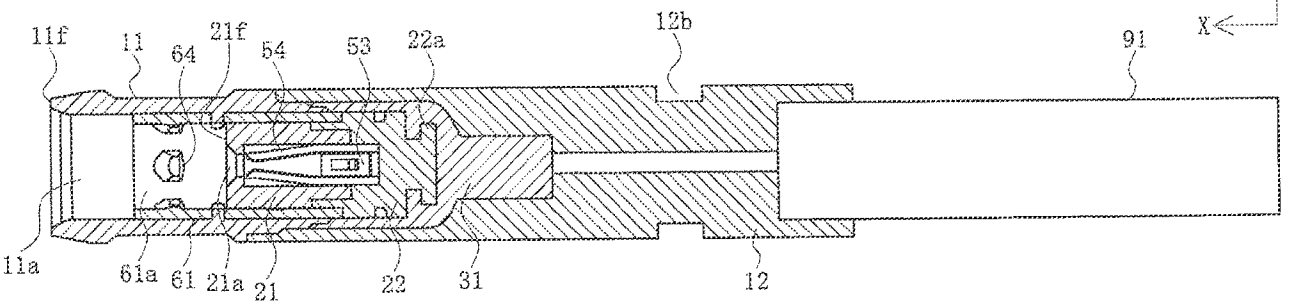
Figure 4C:
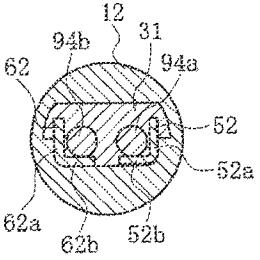
Figure 5A:
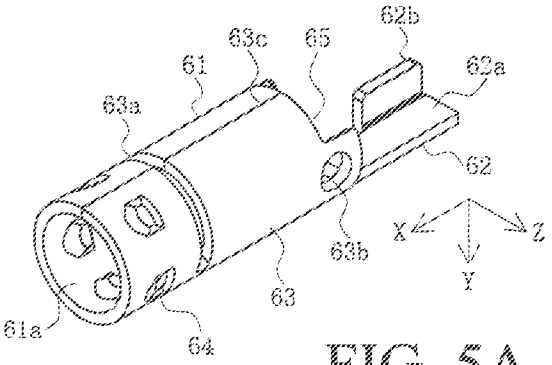
Figure 5B:
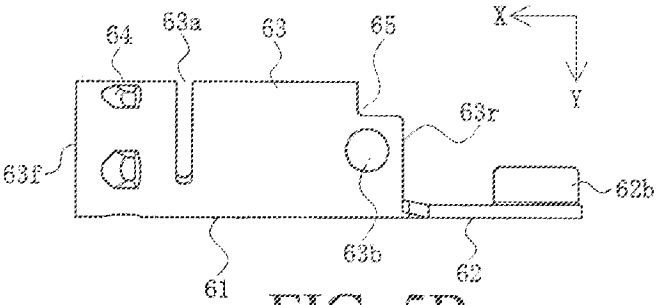
Figure 5C:
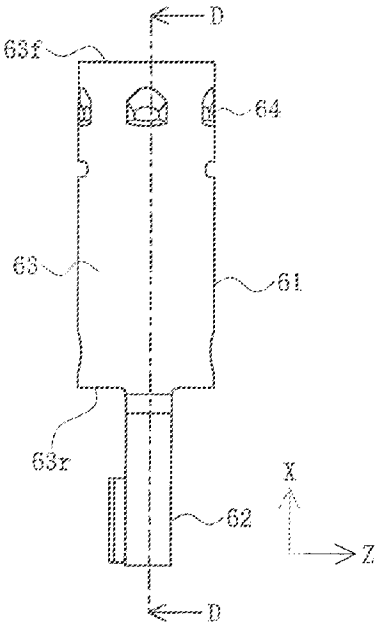
Figure 5D:
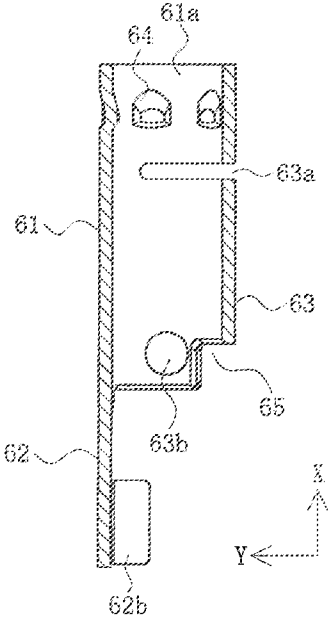
Figure 6A:
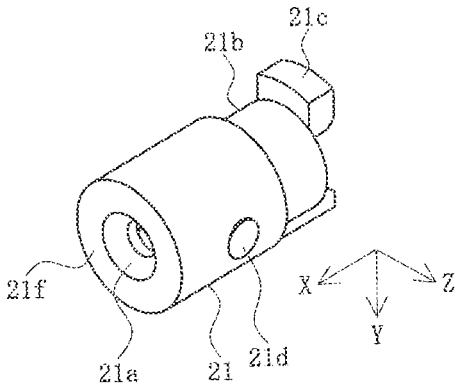
Figure 6B:
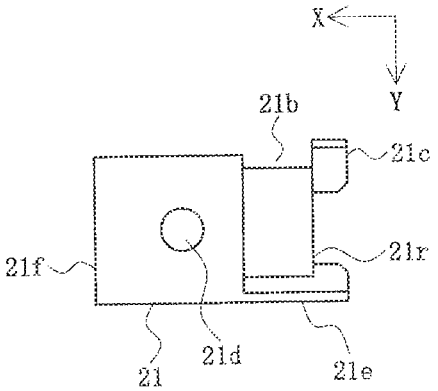
Figure 6C:
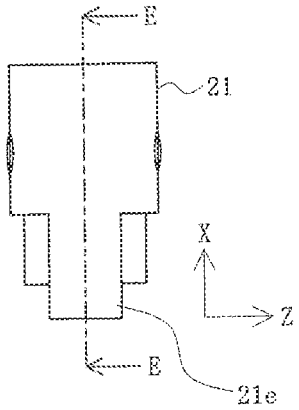
Figure 6D:
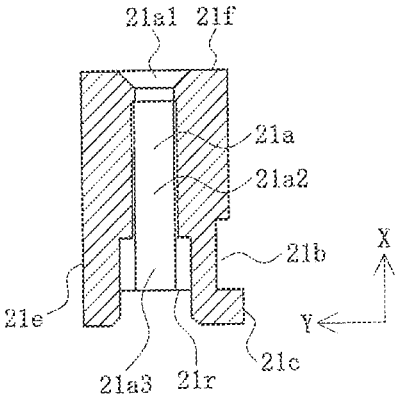
Figure 7B:
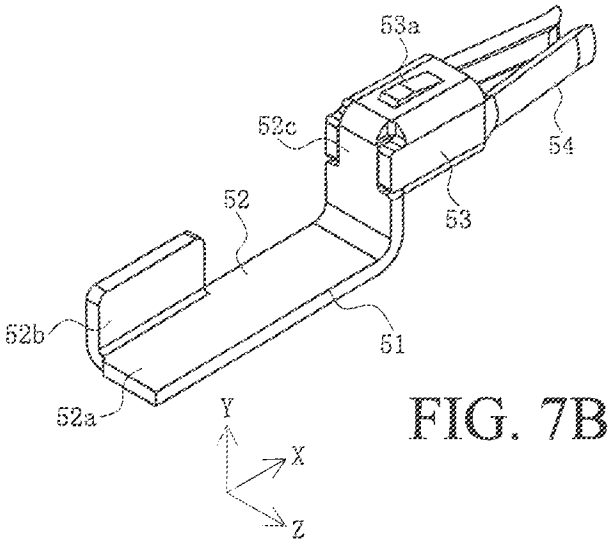
FIGS. 7A-7C are three-side views of a terminal in the present embodiment.
Figure 7A:
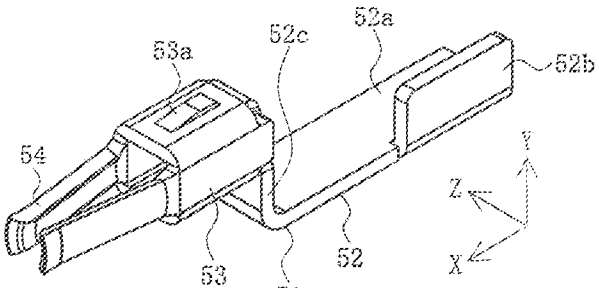
Figure 7C:
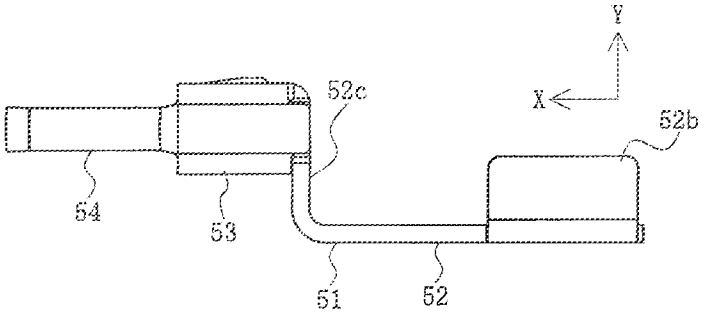
Figure 8A:
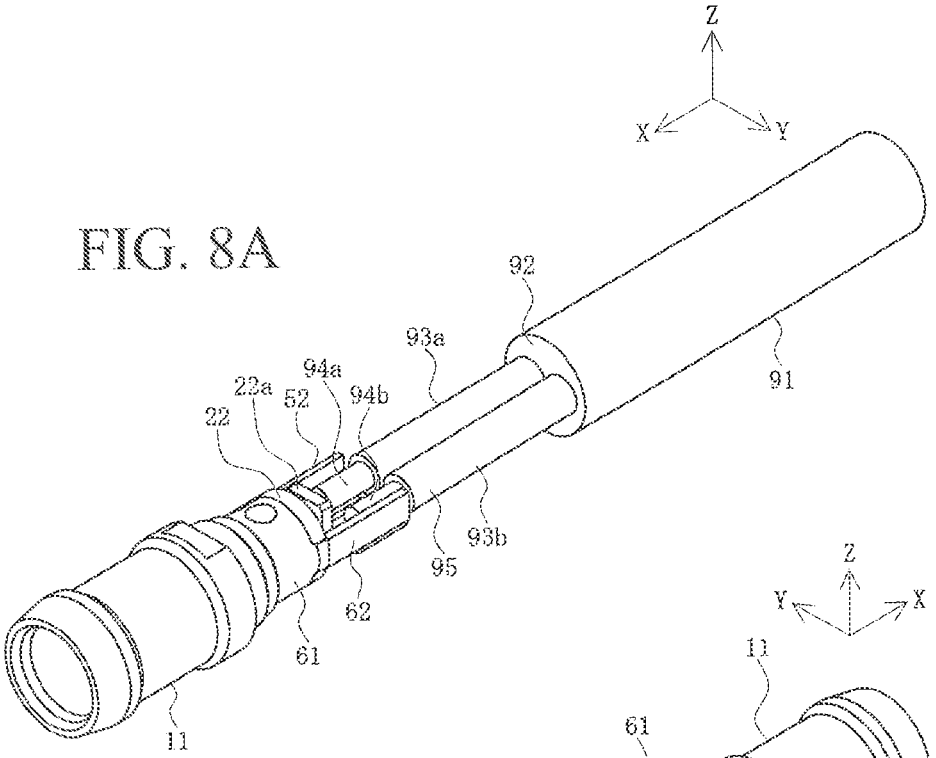
Figure 8B:
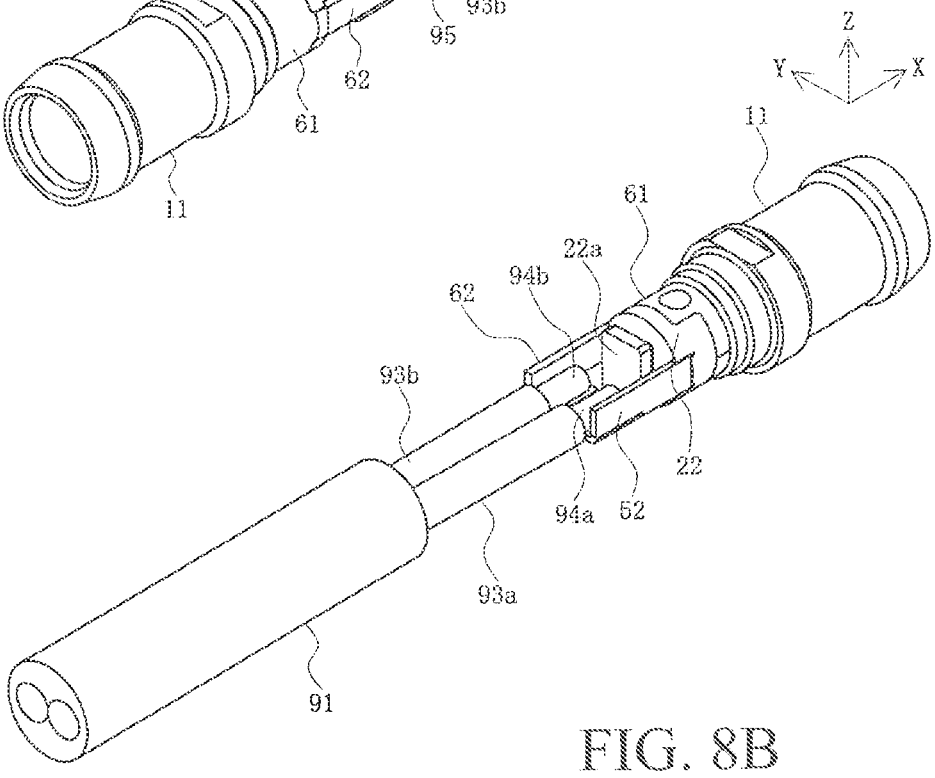
Figure 9A:
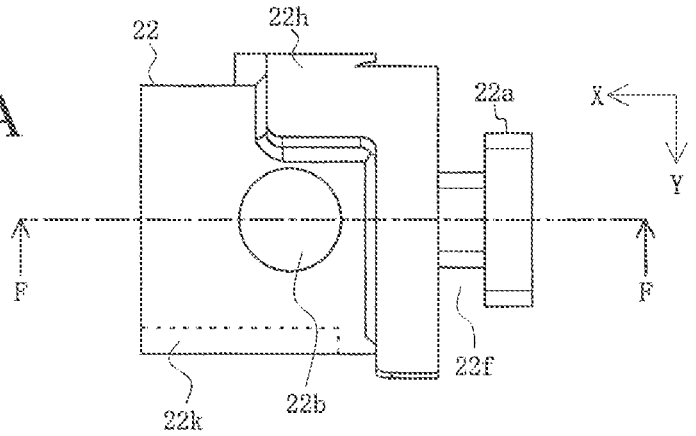
Figure 9B:
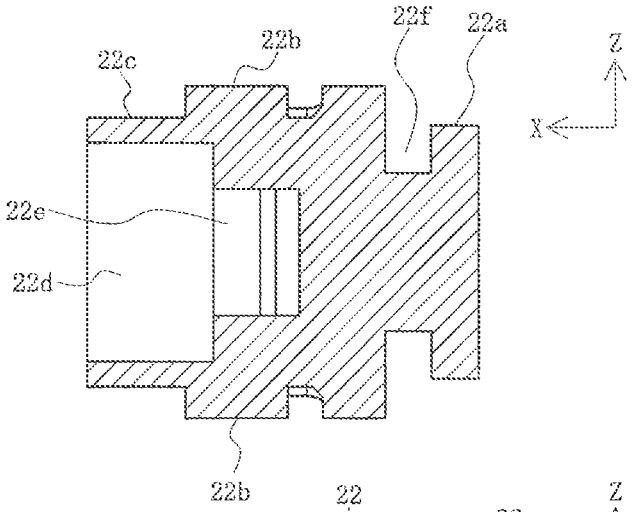
Figure 9C:
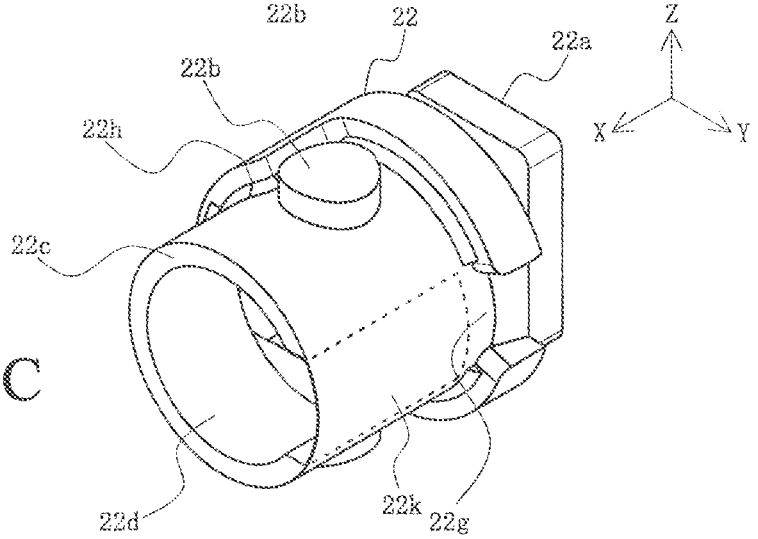
Figure 11A:
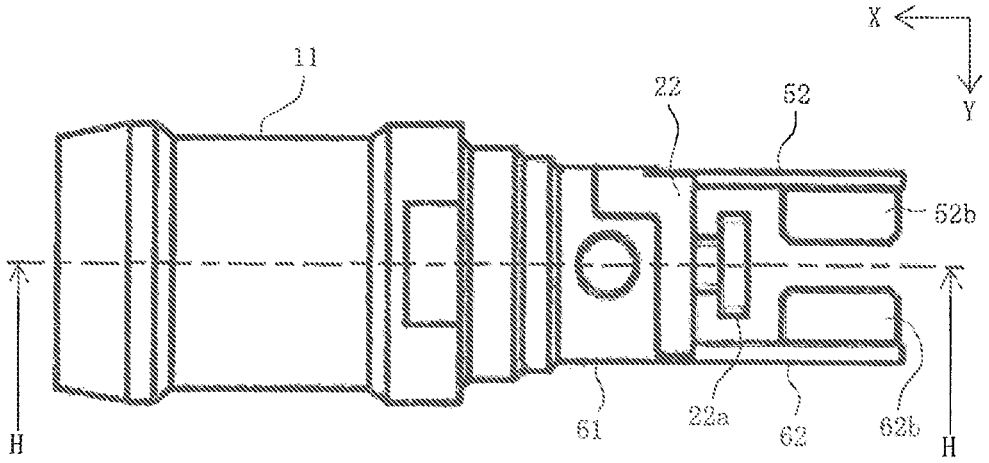
Figure 11B:
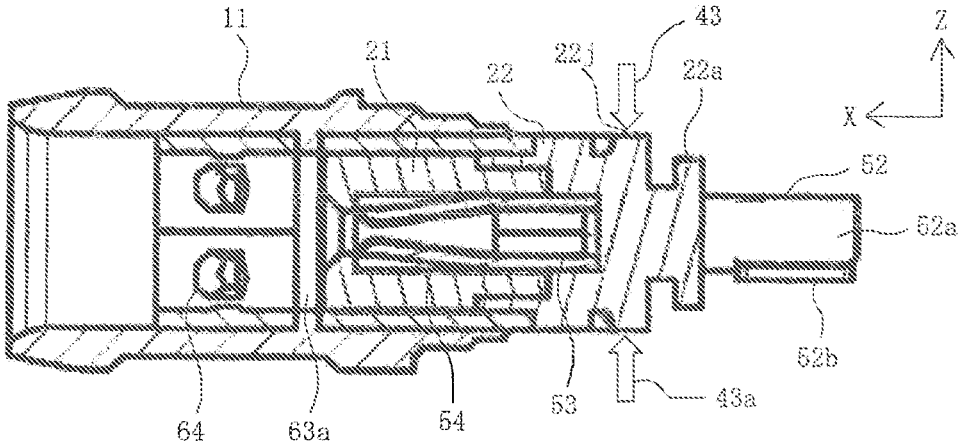

FIG. 1 is a perspective view of a connector according to the present embodiment; FIG. 2 is an exploded view of the connector according to the present embodiment; FIGS. 3A and 3B are two-side views of the connector according to the present embodiment, in which FIG. 3A is a side view and FIG. 3B is a bottom view; FIGS. 4A-4C are cross-sectional views of the connector according to the present embodiment, in which FIG. 4A is a cross-sectional view taken along the arrow A-A in FIG. 3A, FIG. 4B is a cross-sectional view taken along the arrow B-B in FIG. 3B, and FIG. 4C is a cross-sectional view taken along the arrow C-C in FIG. 3A; FIGS. 5A-5D are four-side views of a shell according to the present embodiment, in which FIG. 5A is a perspective view, FIG. 5B is a top view, FIG. 5C is a side view, and FIG. 5D is a cross-sectional view taken along the arrow D-D of FIG. 5C; FIGS. 6A-6D are four-side views of an intermediate insulator according to the present embodiment, in which FIG. 6A is a perspective view, FIG. 6B is a top view, FIG. 6C is a side view, and FIG. 6D is a cross-sectional view taken along the arrow E-E of FIG. 6C; FIGS. 7A-7C are three-side views of a terminal in the present embodiment, FIG. 7A is a perspective view as viewed from the front, FIG. 7B is a perspective view as viewed from the rear, and FIG. 7C is a bottom view; FIGS. 8A and 8B are partial assembling perspective views of the connector according to the present embodiment, in which FIG. 8A is a perspective view as viewed from the front and FIG. 8B is a perspective view as viewed from the rear; FIGS. 9A-9C are first three-side views of a cap according to the present embodiment, in which FIG. 9A is a top view, FIG. 9B is a cross-sectional view taken along the arrow F-F in FIG. 9A, and FIG. 9C is a perspective view as viewed from the front; FIGS. 10A-10C are second three-side views of the cap according to the present embodiment, in which FIG. 10A is a side view, FIG. 10B is a cross-sectional view taken along the arrow G-G in FIG. 10A, and FIG. 10C is a front view; and FIGS. 11A and 11B are partial assembling two-side views of the connector according to the present embodiment, in which FIG. 11A is a top view and FIG. 11B is a cross-sectional view taken along the arrow H-H in FIG. 11A.

In the drawings, reference numeral 1 denotes a connector in the present embodiment, which is one of a pair of connectors which is a connector assembly. The connector 1 is preferably a cable connector, and is used in a state in which the connector 1 is connected to a tip of a cable 91 and is fitted into a mating connector 101 (which will be described later) as the other of the pair of connectors which is the connector assembly. The mating connector 101 is a connector mounted on devices of electric devices, electronic devices, or the like such as a personal computer, a smartphone, a tablet terminal, a vehicle navigation device, a vehicle audio device, a vehicle sensor, an in-vehicle camera, a vehicle light, and a control device for a vehicle, but may be mounted on any type of devices. For convenience of illustration, only a portion close to the tip of the cable 91 is drawn, and the drawing of the other portion is omitted.

In addition, the cable 91 may be any type of cables, and may be a coaxial cable, a twisted pair cable or the like, but as shown in FIG. 2, the cable 91 will be described as being a biaxial cable having two parallel electric wires 93. The cable 91 includes a first electric wire 93*a* in which a circumference of a conductive first core wire 94*a* is covered with an insulating inner covering member 95 and a second electric wire 93*b* covering a circumference of a conductive second core wire 94*b* with an insulating inner covering member 95, and the first electric wire 93*a* and the second electric wire 93*b* arranged in parallel are integrally covered with an insulating outer covering member 92. As shown in FIG. 2, it is assumed that a portion in a predetermined length range from tips of the first core wire 94*a* and the second core wire 94*b* is exposed in a state in which the inner covering member 95 is removed. In addition, when the first core wire 94*a* and the second core wire 94*b* are described in an integrated manner, a core wire 94 will be described, and when the first electric wire 93*a* and the second electric wire 93*b* are described in an integrated manner, the electric wire 93 will be described.

Here, the cable 91 and the connector 1 may be for supplying electric power, or may be for transmitting a signal. In addition, the connector 1 will be described as a connector having a small diameter of, for example, about 3.0 [mm] as an outer diameter (outer diameter of a rear sleeve 12).

In the present embodiment, expressions indicating directions such as up, down, left, right, front, rear, directions or the like used for explaining the configuration and operation of each portion of the connector 1 and the mating connector 101 are not absolute but relative, and it may be appropriate for each portion of the connector 1 and the mating connector 101 to be in postures shown in the drawings. However, when the postures are changed, each portion of the connector 1 and the mating connector 101 needs to be changed and interpreted according to the change in the postures.

The connector 1 includes a front sleeve 11 which is integrally made of an insulating material such as a synthetic resin, a shell 61 as an outer conductor portion which is a member molded by performing processing such as punching, pressing, bending, and the like on a conductive metal plate and housed in the front sleeve 11, an intermediate insulator 21 which is a member integrally formed by the insulating material such as the synthetic resin and housed in the shell 61*a*, a terminal 51 as a central conductor portion which is a member integrally molded by performing the processing such as the punching, pressing, bending, and the like on the conductive metal plate and housed in the intermediate insulator 21, a cap 22 as a lid member which is a member integrally formed by the insulating material such as the synthetic resin preferably having heat resistance and disposed on a rear side of the shell 61 and the terminal 51, a seal member 31 which is a member integrally formed by an elastomer such as the synthetic resin and seals the rear side of the shell 61, the terminal 51, and the cap 22 in a watertight manner, and a rear sleeve 12 which is a member integrally formed by the insulating material such as the synthetic resin and disposed on the rear side of the front sleeve 11.

The front sleeve 11, the cap 22, the seal member 31, and the rear sleeve 12 are members integrated with other members by overmold molding (insert molding), and are not present alone while being separated from the other members, but it is to be noted that the front sleeve 11, the cap 22, the seal member 31, and the rear sleeve 12 are drawn like being present alone in FIG. 2.

As shown in FIGS. 5A-5D, the shell 61 includes a main body portion 63 as a cylindrical outer body portion, and a tail portion 62 as an outer tail portion extending rearward (X-axis negative direction) from a rear end 63*r* of the main body portion 63. The main body portion 63 is a hollow portion manufactured by rolling a flat plate-like metal plate into a cylindrical shape, and includes a seam 63*c* extending in a front-rear direction (X-axis direction). An inside of the main body portion 63 is formed in a columnar internal cavity 61*a*, and the intermediate insulator 21 and the terminal 51 are housed in the internal cavity 61*a*.

In addition, the main body portion 63 is formed so that a slit 63*a* extending in a circumferential direction is caught in the seam 63*c*. The slit 63*a* is a portion into which a part of the insulating material constituting the front sleeve 11 enters and is formed so as to penetrate the metal plate constituting the main body portion 63 in a thickness direction, but is not present over the entire circumference of the main body portion 63. The intermediate insulator 21 and the terminal 51 are housed in a rear side of the slit 63*a* in the internal cavity 61*a* in a lightly press-fitted state by a small protrusion 21*d* provided outside the intermediate insulator 21. That is, the small protrusion 21*d* as a lightly press-fitted portion is positioned behind the slit 63*a*. A plurality of lock protrusions 64 protruding inward in a radial direction are formed in a range between a front end 63*f* and the slit 63*a* in the main body portion 63. The lock protrusion 64 is engaged with a mating shell 161 (which will be described later) included in the mating connector 101 which is fitted into the connector 1.

When the mating shell 161 enters into the internal cavity 61*a* from the front end 63*f* and engages with the lock protrusion 64 protruding inward in the radial direction, since the lock protrusion 64 is pushed outward in the radial direction by the mating shell 161, the range between the front end 63*f* and the slit 63*a* in the main body portion 63 is changed so that the diameter is enlarged. However, due to the presence of the slit 63*a*, such deformation is not transmitted to the rear side of the slit 63*a*. Therefore, even when the fixing strength of the intermediate insulator 21 to the shell 61 cannot be increased due to miniaturization, the intermediate insulator 21 housed in the rear side of the slit 63*a* in the internal cavity 61*a* is not separated from the main body portion 63.

In addition, the rear end 63*r* of the main body portion 63 is provided with a cutout portion 65 which is recessed forward. A positioning protrusion 21*c* of the intermediate insulator 21 enters the cutout portion 65 to be engaged with the cutout portion 65. In addition, an opening 63*b* penetrating the metal plate constituting the main body portion 63 in the thickness direction is formed near the rear end 63*r* of the main body portion 63. A part of the insulating material forming the cap 22 enters the opening 63*b* formed so as to penetrate through a side wall of the main body portion 63.

A first connection plate 62*a* and a second connection plate 62*b* which are orthogonal to each other as viewed from a longitudinal direction (X-axis direction) of the connector 1, that is, the front-rear direction are disposed near a rear end of the tail portion 62. The second connection plate 62*b* is formed by being bent so as to be a right angle to the first connection plate 62*a*. As shown in FIG. 4C, the second core wire 94*b* exposed in a state in which the inner covering member 95 is removed at the tip of the second electric wire 93*b* of the cable 91 abuts against or is close to the first connection plate 62*a* and the second connection plate 62*b* at each of the two locations orthogonal to each other as viewed in the front-rear direction on the circumferential surface thereof, and is connected to the first connection plate 62*a* and the second connection plate 62*b* by a connection means such as soldering. Therefore, even if a range in which the second core wire 94*b* overlaps the tail portion 62 is short in the front-rear direction, since the second core wire 94*b* is connected to the first connection plate 62*a* and the second connection plate 62*b* at two locations on the circumferential surface of the second core wire 94*b*, the second core wire 94*b* and the tail portion 62 are reliably connected to each other and reliably conducted to each other.

The front sleeve 11 is integrally attached to the outside of the shell 61 by overmold molding. As described above, since a part of the insulating material forming the front sleeve 11 enters the slit 63*a* of the shell 61, the front sleeve 11 is reliably attached to the shell 61. The front sleeve 11 is a substantially cylindrical member, and has a columnar internal cavity 11*a* penetrating in an axial direction, that is, the front-rear direction, and the shell 61 is in a state in which most of the front side of the cutout portion 65 in the main body portion 63 is housed in the internal cavity 11*a*. In addition, as shown in FIGS. 4A and 4B, the front sleeve 11 is in a state in which the front sleeve 11 extends forward from the front end 63*f* of the main body portion 63 of the shell 61, and the shell 61 is not present in a range having a predetermined length in which the front sleeve 11 extends rearward from the front end 11*f* of a housing in the internal cavity 11*a*. In addition, a central axis of the internal cavity 11*a* is coaxial with the central axis of the internal cavity 61*a* of the shell 61, and an internal diameter of the internal cavity 11*a* is substantially the same as an external diameter of the shell 61.

As shown in FIGS. 6A-6D, the intermediate insulator 21 is a substantially cylindrical member and has a columnar internal cavity 21*a* penetrating in the axial direction, that is, the front-rear direction. A portion in contact with the front end 21*f* in the internal cavity 21*a* is provided with a tapered portion 21*a*1 whose inner diameter is increased as going forward (X-axis forward direction). In addition, a portion in contact with a rear end 21*r* in the internal cavity 21*a* is provided with a square hole portion 21*a*3 having a rectangular cross section. In addition, a portion between the tapered portion 21*a*1 and the square hole portion 21*a*3 in the internal cavity 21*a* is a round hole portion 21*a*2 having a smaller inner diameter than that of the square hole portion 21*a*3 having a circular cross section. The terminal 51 is housed in the internal cavity 21*a*, the main body portion 53 of the terminal 51 is housed in the square hole portion 21*a*3, and a contact arm portion 54 of the terminal 51 is housed in the round hole portion 21*a*2. The tapered portion 21*a*1 functions as a guide portion for smoothly inserting a tip of a mating terminal 151 (which will be described later) included in the mating connector 101 which is fitted into the connector 1 without the terminal 51.

In addition, a recessed portion 21*b* is formed in the predetermined length range in front of the rear end 21*r* in the intermediate insulator 21. The recessed portion 21*b* is a portion into which a part of the insulating material forming the cap 22 enters, and is formed so as to be further recessed than the outer circumferential surface of the intermediate insulator 21, but is not present over the whole circumference of the intermediate insulator 21. In addition, a part of the rear end 21*r* is provided with the positioning protrusion 21*c* protruding rearward and outward in the radial direction. The positioning protrusion 21*c* protrudes outward in the radial direction from the outer circumferential surface of the intermediate insulator 21 and enters the cutout portion 65 of the shell 61 to be engaged with the cutout portion 65.

The intermediate insulator 21 is press-fitted into the internal cavity 61*a* of the shell 61 from behind. At this time, the positioning protrusion 21*c* enters the cutout portion 65 of the shell 61 from behind to be engaged with the cutout portion 65, such that the positioning of the intermediate insulator 21 is performed with respect to the shell 61 in the front-rear direction and the circumferential direction.

As shown in FIGS. 7A-7C, the terminal 51 includes the main body portion 53 as a square tubular central body portion having a rectangular cross section, a pair of contact arm portions 54 extending forward from the main body portion 53, and a tail portion 52 as a central tail portion extending rearward from the main body portion 53. The main body portion 53 is a portion formed by bending a flat plate-like metal plate into a square tubular shape, and one of the side walls of a square tube is provided with an engaging protrusion 53*a* protruding outward. In addition, proximal ends of the contact arm portions 54 are integrally connected to the front ends of the pair of side walls of the square tube. The contact arm portion 54 functions as a cantilever-like leaf spring. A distance between the contact arm portions 54 facing each other is narrowed toward the front, and a distance between the contact arm portions 54 at the tip, that is, a free end is preferably set to be smaller than an outer diameter of a contact portion 154 of the mating terminal 151. When the connector 1 and the mating connector 101 are fitted into each other, since the mating terminal 151 enters between the contact arm portions 54 facing each other to widen the distance between the contact arm portions 54, the contact arm portions 54 functioning as the cantilever-like leaf spring sandwiches the mating terminal 151 from both sides thereof, such that the contact between the contact arm portion 54 and the mating terminal 151 is reliably maintained and conducted.

The tail portion 52 has a connection portion 52*c* integrally connected to the main body portion 53. The connection portion 52*c* is a member for connecting the rear end of the main body portion 53 and the front end of the tail portion 52 and extends in a direction orthogonal to the front-rear direction (in the example shown in the drawing, a Y-axis direction), and functions as a lid member which closes the rear end of the square tubular main body portion 53. In the example shown in the drawing, the connection portion 52*c* is bent at a substantially right angle from the rear end of the side wall on which the engaging protrusion 53*a* is formed in the square tube of the main body portion 53, and extends in the direction (Y-axis negative direction) of the side wall facing the side wall, passes over the side walls facing each other, is bent at a substantially right angle and is then integrally connected to the front end of the tail portion 52 extending in the front-rear direction. In this manner, since the rear end of the square tubular main body portion 53 is closed by the connection portion 52*c*, the insulating material forming the cap 22 or the elastomer forming the seal member 31 is reliably prevented from entering into the square tube from the rear end and entering between the pair of contact arm portions 54.

In addition, the first connection plate 52*a* and the second connection plate 52*b* which are orthogonal to each other as viewed from a longitudinal direction (X-axis direction) of the connector 1, that is, the front-rear direction are disposed near the rear end of the tail portion 52. The second connection plate 52*b* is formed by being bent so as to be a right angle to the first connection plate 52*a*. As shown in FIG. 4C, the first core wire 94*a* exposed in a state in which the inner covering member 95 is removed at the tip of the first electric wire 93*a* of the cable 91 abuts against or is close to the first connection plate 52*a* and the second connection plate 52*b* at each of the two locations orthogonal to each other as viewed in the front-rear direction on the circumferential surface thereof, and is connected to the first connection plate 52*a* and the second connection plate 52*b* by the connection means such the soldering. Therefore, even if a range in which the first core wire 94*a* overlaps the tail portion 52 is short in the front-rear direction, since the first core wire 94*a* is connected to the first connection plate 52*a* and the second connection plate 52*b* at two locations on the circumferential surface of the first core wire 94*a*, the first core wire 94*a* and the tail portion 52 are reliably connected to each other and reliably conducted to each other.

The terminal 51 is press-fitted into the internal cavity 21*a* of the intermediate insulator 21 from behind. Then, the square tubular main body portion 53 enters the square hole portion 21*a*3 formed in the portion which is in contact with the rear end 21*r* in the internal cavity 21*a*, and the pair of contact arm portions 54 enter the round hold portion 21*a*2 positioned in front of the square hole portion 21*a*3. At this time, the inner diameter of the round hole portion 21*a*2 is smaller than the outer diameter of the main body portion 53, and the portion near the front end of the tail portion 52 in the connection portion 52*c* abuts against a rear surface of the positioning protrusion 21*c*, such that the positioning of the terminal 51 with respect to the intermediate insulator 21 is performed in the front-rear direction without the main body portion 53 entering the round hole portion 21*a*2. In addition, since the square tubular main body portion 53 is housed in the square hole portion 21*a*3, the positioning of the terminal 51 with respect to the intermediate insulator 21 is performed in the circumferential direction. Since the engaging protrusion 53*a* of the main body portion 53 intrudes on the inner wall of the square hole portion 21*a*3, the terminal 51 is not displaced in the front-rear direction with respect to the intermediate insulator 21. Further, as shown in FIGS. 4A and 4B, the contact arm portion 54 stops in the round hole portion 21*a*2 and does not enter the tapered portion 21*al*.

In addition, in the state in which the terminal 51 is press-fitted into the internal cavity 21*a* of the intermediate insulator 21 press-fitted into the internal cavity 61*a* of the shell 61, as shown in FIG. 4A, the tail portion 52 of the terminal 51 extends rearward facing the tail portion 62 of the shell 61. Specifically, the tail portion 52 of the terminal 51 is substantially flush with the cylindrical wall of the cylindrical main body portion 63 of the shell 61, is located on the opposite side of the tail portion 62 of the shell 61 in the circumferential direction, and extends rearward. That is, the tail portion 52 of the terminal 51 and the tail portion 62 of the shell 61 form a part of a cylindrical wall surface having substantially the same diameter as the cylindrical wall surface of the main body portion 63 of the shell 61. In addition, the position of the rear end of the tail portion 52 of the terminal 51 is the same as the position of the rear end of the tail portion 62 of the shell 61 in the front-rear direction, and the position of the first connection plate 52*a* and the second connection plate 52*b* of the terminal 51 is also the same as the position of the first connection plate 62*a* and the second connection plate 62*b* of the shell 61. As shown in FIG. 4C, the first connection plate 52*a* of the terminal 51 and the first connection plate 62*a* of the shell 61 face each other, and the second connection plate 52*b* of the terminal 51 and the second connection plate 62*b* of the shell 61 are substantially flush with each other.

In this way, after the intermediate insulator 21 is press-fitted into the internal cavity 61*a* of the shell 61 and the terminal 51 is press-fitted into the internal cavity 21*a* of the intermediate insulator 21, the cap 22 as shown in FIGS. 9A-9C and 10A-10C is integrally molded on the rear side of the intermediate insulator 21 and the terminal 51 by the overmold molding. For the sake of convenience, in FIGS. 9A-9C and 10A-10C, the cap 22 is shown independently, but the cap 22 is subjected to the overmold molding (insert molding) which fills a dielectric material such as a synthetic resin in a die in a state in which the intermediate insulator 21, the terminal 51, and the shell 61 are mounted in the die for molding, and thus becomes a member integrally molded with the intermediate insulator 21, the terminal 51, and the shell 61, such that the cap 22 does not actually exist as a single body having a shape as shown in FIGS. 9A-9C and 10A-10C.

As a result, the insulating material forming the cap 22 enters the rear end 63*r* of the main body portion 63 of the shell 61 having the intermediate insulator 21 and the terminal 51 housed therein and the gap between the shell 61, the intermediate insulator 21, and the terminal 51 in the vicinity of the rear end 63*r* on the outer circumferential surface of the main body portion 63 to close the rear end 63*r* of the main body portion 63 of the shell 61 and the gap between the shell 61, the intermediate insulator 21, and the terminal 51. In addition, the insulating material forming the cap 22 passes through the recessed portion 21*b* of the intermediate insulator 21, enters the opening 63*b* formed in the main body portion 63 of the shell 61, and is filled in the recessed portion 21*b* and the opening 63*b* to form the cap 22, such that the cap is reliably attached to the shell 61 and the intermediate insulator 21. In addition, since the rear end closed by the connection portion 52*c* is closed by the cap 22 from behind, the main body portion 53 of the terminal 51 housed in the square hole portion 21*a*3 of the internal cavity 21*a* of the intermediate insulator 21 is not extracted from the square hole portion 21*a*3.

Specifically, the cylindrical portion 22*c* of the cap 22 enters the recessed portion 21*b* of the intermediate insulator 21 positioned in the internal cavity 61*a* of the main body portion 63 from the rear end 63*r* side of the main body portion 63 of the shell 61, an outer portion 22*h* positioned outward in a radial direction from the cylindrical portion 22*c* enters between a cutout portion 65 of the shell 61 and the positioning protrusion 21*c* of the intermediate insulator 21 and covers the positioning protrusion 21*c*, and a protruding portion 22*b* protruding outward in the radial direction from the outer surface of the cylindrical portion 22*c* enters the opening 63*b* of the shell 61. In addition, the vicinity of the rear end of the intermediate insulator 21 enters into a front cavity 22*d* formed in the cylindrical portion 22*c*, the vicinity of the rear end of the main body portion 53 of the terminal 51 enters into a rear cavity 22*e* behind the front cavity 22*d*, the vicinity of the front end of the tail portion 62 of the shell 61 enters into a cutout portion 22*g* on the outer circumference, and the positioning protrusion 21*c* enters into an outer cavity 22*i* in the outer portion 22*h*.

The recessed portion 21*b* of the intermediate insulator 21 does not extend over the whole circumference of the intermediate insulator 21, and as shown in FIGS. 6A-6D, a rear side protruding portion 21*e* is formed on a part of the circumference of the intermediate insulator 21. Therefore, the cylindrical portion 22*c* of the cap 22 is provided with a recessed portion of 22*m* corresponding to the rear protruding portion 21*e*, as shown in FIG. 10A-10C and is provided with a thin wall portion 22*k* entering the small gap between the outer circumferential surface of the intermediate insulator 21 and the inner circumferential surface of the main body portion 63 of the shell 61, as shown in FIGS. 9A-9C and 10A-10C. Although the thin wall portion 22*k* may not be formed due to the variation of the gap, even if the thin wall portion 22*k* is not formed, the waterproof property is not affected due to the cap 22.

As described above, the cap 22 is molded by the overmold molding, and thus even if each member becomes small for miniaturization, the cap 22, the intermediate insulator 21, the shell 61, and the terminal 51 can be reliably integrated. FIGS. 11A and 11B show a partial assembly in the state in which the front sleeve 11 is molded by the overmold molding. In addition, when the cap 22 is molded by the overmold molding, the gate formed on the wall surface of the molding mold (die) (not shown) is positioned immediately in front of the rear surface of the cap 22 as shown in FIG. 11B, and the insulating material forming the cap 22 through the gate is filled in the molding mold as indicated by the arrow 43 and enters each portion to integrate the portions. The gate may be only one point, but may be a multipoint. For example, the gates 43 and 43*a* can be provided to face each other on both sides of the cap 22 in a Z-axis direction. As a result, when filling the molding mold with the insulating material, the pressure of the insulating material acting on parts in the molding mold is more likely to be uniform, and the occurrence of short molding due to the deviation of the parts is suppressed. It is to be noted that a gate trace 22*j* remains on the surface of the molded cap 22.

As shown in FIGS. 8A and 8B, the outer circumferential surface of the cap 22 becomes a circumferential surface which is substantially flush with the outer circumferential surface of the cylindrical main body portion 63 of the shell 61. In addition, an umbrella-like or mushroom-like anchor portion 22*a* protruding rearward is formed on the rear surface of the cap 22, and a constricted portion 22*f* is formed between the rear surface of the cap 22 and the anchor portion 22*a*. The tail portion 62 of the shell 61 is exposed by protruding reward from a boundary portion between the rear surface and the circumferential surface of the cap 22 so that at least the first connection plate 62*a* and the second connection plate 62*b* are positioned behind the anchor portion 22*a*. Similarly, the tail portion 52 of the terminal 51 is exposed by protruding reward from the boundary portion between the rear surface and the circumferential surface of the cap 22 so that at least the first connection plate 52*a* and the second connection plate 52*b* are positioned behind the anchor portion 22*a*.

The core wire 94 of the cable 91 is connected to the tail portion 52 of the terminal 51 and the tail portion 62 of the shell 61. Here, the first connection plate 52*a* and the second connection plate 52*b* of the tail portion 52 of the terminal 51, and the first connection plate 62*a* and the second connection plate 62*b* of the tail portion 62 of the shell 61 are disposed at the same position behind the anchor portion 22*a* of the cap 22 in the front-rear direction, the first connection plate 52*a* of the terminal 51 and the first connection portion 62*a* of the shell 61 face each other, and the second connection plate 52*b* of the terminal 51 and the second connection plate 62*b* of the shell 61 are substantially flush with each other.

Therefore, the first core wire 94*a* and the second core wire 94*b* of the cable 91 arranged in parallel with the inner covering member 95 removed and exposed are mounted on the second connection plate 52*b* of the terminal 51 and the second connection plate 62*b* of the shell 61 which are arranged in parallel, and as a result, as shown in FIGS. 8A and 8B, the first core wire 94*a* abuts against or is close to the first connection plate 52*a* and the second connection plate 52*b* of the tail portion 52 of the terminal 51 and the second core wire 94*b* abuts against or is close to the first connection plate 62*a* and the second connection plate 62*b* of the tail portion 62 of the shell 61. By performing the connection such as soldering, two locations on the circumferential surface of the first core wire 94*a* are connected to the first connection plate 52*a* and the second connection plate 52*b*, and two locations on the circumferential surface of the second core wire 94*b* are also connected to the first connection plate 62*a* and the second connection plate 62*b*. In this way, since the first core wire 94*a* and the second core wire 94*b* of the cable 91 can be connected to the tail portion 52 of the terminal 51 and the tail portion 62 of the shell 61 by a relatively simple work operation, for example, a robot or the like can be used, the assembling work of the connector 1 can be simplified and rationalized, and the production cost can be reduced. In addition, since two locations on the circumferential surface of the first core wire 94*a* are connected to the first connection plate 52*a* and the second connection plate 52*b* and two locations on the circumferential surface of the second core wire 94*b* are connected to the first connection plate 62*a* and the second connection plate 62*b*, even if the overlapping length of the first core wire 94*a* and the second core wire 94*b* with the tail portion 52 and the tail portion 62 is short in the front-rear direction, the total sum of the lengths of the first core wires 94*a* connected to the tail portions 52 and the total length of the second core wires 94*b* connected to the tail portions 62 become longer, such that the connection is reliably made.

In this way, after the core wire 94 of the cable 91 is connected to the tail portion 52 of the terminal 51 and the tail portion 62 of the shell 61, the seal member 31 is integrally attached to the rear side of the terminal 51, the shell 61, and the cap 22 by the overmold molding. The elastomer forming the seal member 31 which is a material having higher flexibility than the material of the front sleeve 11, the cap 22 and the rear sleeve 12 enters the gaps existing between the shell 61, the intermediate insulator 21, the terminal 51, and the cap 22, thereby sealing the gaps in the watertight manner. In addition, the elastomer covers the tail portion 52 of the terminal 51 and the tail portion 62 of the shell 61 exposed at the rear side of the cap 22 and the circumference of the core wire 94 of the cable 91 connected thereto without the gaps, and the gaps are sealed in the watertight manner. Preferably, as shown in FIGS. 4A-4C, the seal member 31 is formed so that the front side of the seal member 31 overlaps the rear end on the outer circumferential surface of the front sleeve 11 and the vicinity of the rear end in the front-rear direction, and the rear side thereof covers the circumferences of each member in a range up to at least the anchor portion 22*a* of the cap 22. In addition, the seal member 31 may be formed so as to cover the circumferences of each member in a range up to a portion close to the front end on the outer circumferential surface of the inner covering member 95 of the electric wire 93 without gaps.

Therefore, the anchor portion 22*a* of the cap 22 is buried in the seal member 31, and the seal member 31 enters the circumference of the constricted portion 22*f*, so that the cap 22 and the seal member 31 are reliably coupled to each other. In addition, since the elastomer forming the seal member 31 has high flexibility and covers the tail portion 52 of the terminal 51 and the tail portion 62 of the shell 61 and the circumference of the core wire 94 of the cable 91 connected thereto without gaps, the tail portion 52 of the terminal 51, the tail portion 62 of the shell 61, and the core wire 94 can be reliably waterproofed.

After the seal member 31 is integrally molded by the overmold molding, the seal member 31 and the shell 61 come into close contact with each other by reheating, so that the waterproof property can be further enhanced.

Then, the rear sleeve 12 is integrally attached on the rear side of the front sleeve 11 by the overmold molding so as to cover the circumferences of the seal member 31 and the electric wire 93 of the cable 91. The rear sleeve 12 is a member for forming the outermost layer of the connector 1 together with the front sleeve 11, and preferably, as shown in FIGS. 4A-4C, is formed to cover the circumferences of each member without gaps in a range from the portion close to the rear end on the outer circumferential surface of the front sleeve 11 to the portion close to the front end on the outer circumferential surface of the outer covering member 92 of the cable in the front-rear direction.

It is to be noted that the rear sleeve 12 may have the recessed portion 12*b* that exists over the whole circumference of the outer surface. The recessed portion 12 is used for hooking a jig (not shown) at the time of fitting or unfitting the connector 1 and the mating connector 101, that is, at the time of inserting/extracting the connector 1. In addition, when the rear sleeve 12 is molded by the overmold molding, the gate formed on the wall surface of the molding mold (cast) (not shown) is positioned immediately behind the recessed portion 12*b* as shown in FIG. 4A, and the insulating material forming the rear sleeve 12 through the gate is filled in the molding mold as shown by the arrow 41.

It is preferable that the gates face each other on both sides of the rear sleeve 12 in the Y-axis direction. As a result, when filling the molding mold with the insulating material as shown in the arrow 41, the pressure of the insulating material acting on parts in the molding mold is more likely to be uniform, and the occurrence of short molding due to the deviation of the parts is suppressed. The position of the gate is preferably close to the outer covering member 92 so as to enhance the weldability between the insulating material forming the rear sleeve 12 and the outer covering member 92 of the cable 91, but the presence of the outer covering member 92 right under the gate is undesirable because the outer covering member 92 is deformed by an injection pressure of the insulating material. In addition, when the rear sleeve 12 has the recessed portion 12*b*, the position of the gate is preferably closer to the outer covering member 92 than the recessed portion 12*b*. If the position of the gate is closer to the front sleeve 11 than the thin recessed portion 12*b*, the pressure necessary for filling the molding mold with the insulating material becomes high, and the cable 91 may be deformed. Considering these facts, it is preferable that the gate is at the position as shown in FIG. 4A. It is to be noted that a gate trace 12*c* remains on the surface of the molded rear sleeve 12.

In addition, the insulating material filled in the molding mold overflows and flows out from the molding mold as shown by the arrow 42. It is preferable that the outflow of the insulating material due to the overflow is also made at positions facing each other on both sides of the rear sleeve 12 in the Y-axis direction. The insulating material overflows, such that the weldability between the insulating material forming the rear sleeve 12 and the outer covering member 92 of the cable 91 becomes high, thereby increasing the waterproof property. It is preferable that the position at which the insulating material flows out is close to the rear end 12*r* of the rear sleeve 12 in order to enhance the weldability between the insulating material and the outer covering member 92. It is to be noted that an overflow trace 12*d* remains on the surface of the molded rear sleeve 12.

Next, a configuration of the mating connector 101 will be described.

Figure 12A:
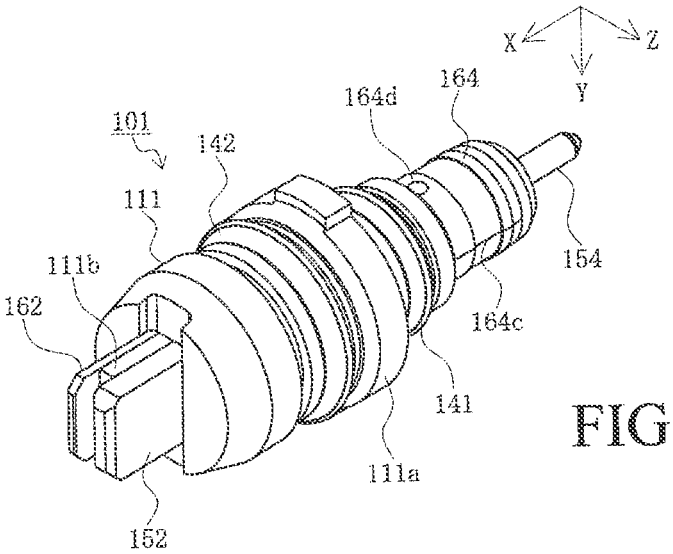
Figure 12B:
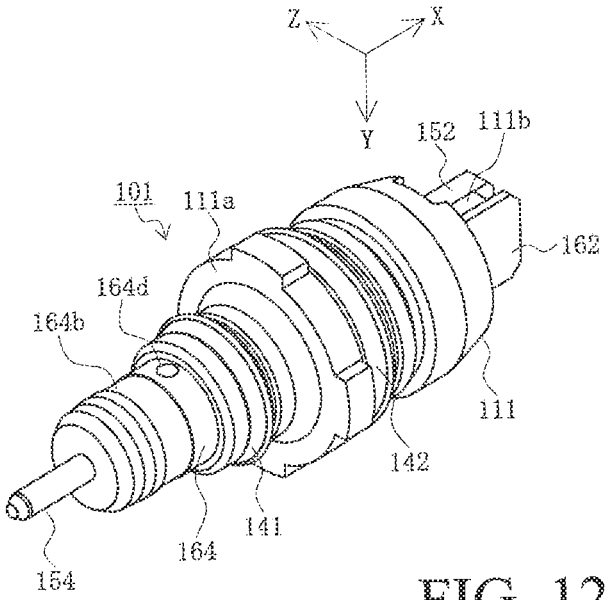
Figure 13A:
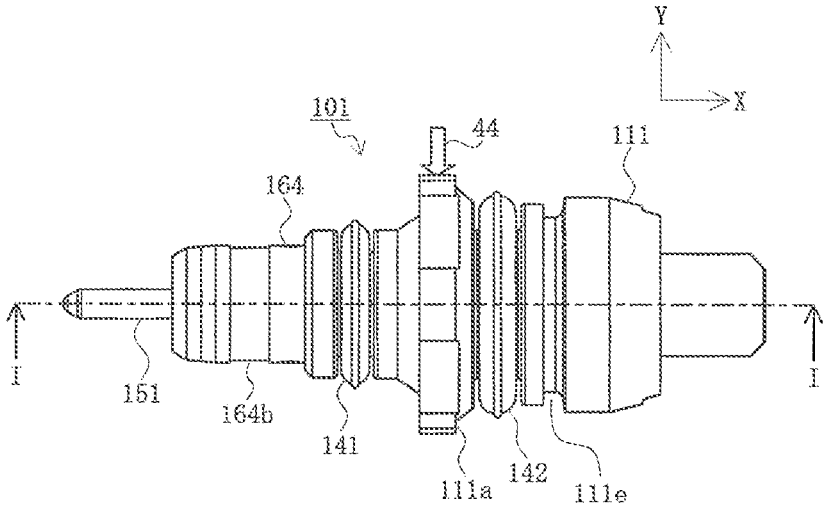
Figure 13B:
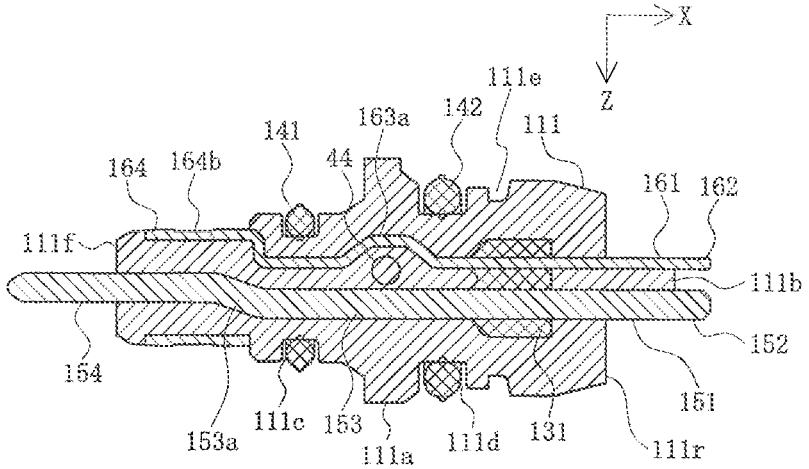
Figure 14B:
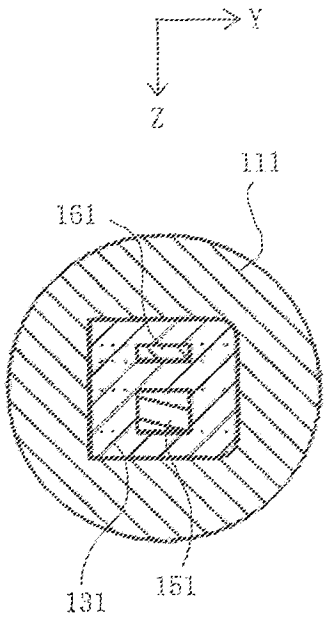
Figure 14A:
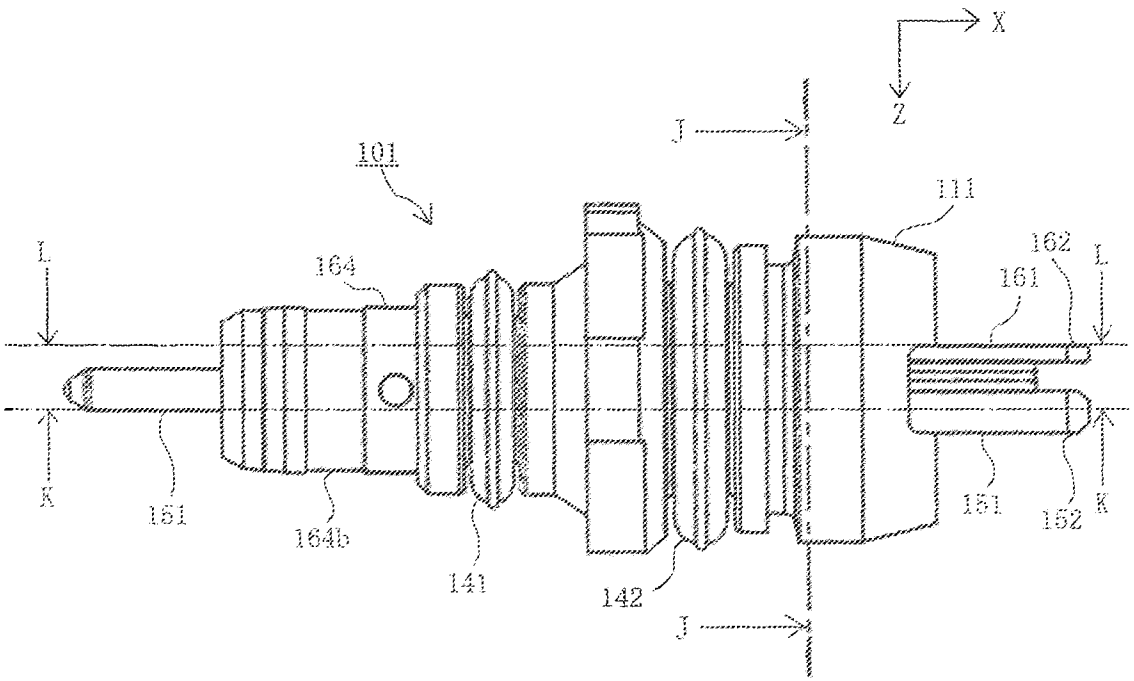

FIGS. 12A and 12B are perspective views of a mating connector according to the present embodiment, in which FIG. 12A is a perspective view as viewed from the rear and FIG. 12B is a perspective view as viewed from the front; FIGS. 13A and 13B are first two-side views of the mating connector according to the present embodiment, in which FIG. 13A is a top view and FIG. 13B is a cross-sectional view taken along the arrow I-I in FIG. 13A; FIGS. 14A and 14B are second two-side views of the mating connector according to the present embodiment, in which FIG. 14A is a side view and FIG. 14B is a cross-sectional view taken along the arrow J-J in FIG. 14A; FIGS. 15A-15D are longitudinal cross-sectional views of the mating connector according to the present embodiment, in which FIG. 15A is a cross-sectional view taken along the arrow K-K in FIG. 14B, FIG. 15B is a cross-sectional view taken along the arrow L-L in FIG. 14B, and FIGS. 15C and 15D are partial modification examples of FIGS. 15A and 15B; FIGS. 16A and 16B are two-side views of the mating terminal according to the present embodiment, in which FIG. 16A is a perspective view as viewed from the front and FIG. 16B is a perspective view as viewed from the rear; and FIGS. 17A and 17B are two-side views of a mating shell according to the present embodiment, in which FIG. 17A is a perspective view as viewed from the front and FIG. 17B is a side view.

The mating connector 101 includes a mating housing 111 which is integrally formed by an insulating material such as a synthetic resin, the mating shell 161 as the mating outer conductor portion which is a member molded by performing processing such as punching, pressing, bending and the like on the conductive metal plate and is housed in the mating housing 111, the mating terminal 151 as the mating central conductor portion which is a member integrally molded by performing the punching, pressing, bending and the like on the conductive metal plate and housed in the mating housing 111, the mating seal member 131 which is a member integrally formed by an elastomer, rubber or the like such as a synthetic resin and seals the rear side of the mating shell 161 and the mating terminal 151 in the watertight manner, and the first outer seal member 141 and the second outer seal member 142 as an O-ring which is a member integrally formed by an elastomer such as a synthetic resin and attached on the outer circumferential surface of the mating housing 111.

The mating housing 111 and the mating seal member 131 are members which are integrated with other members by the overmold molding.

Figure 17A:
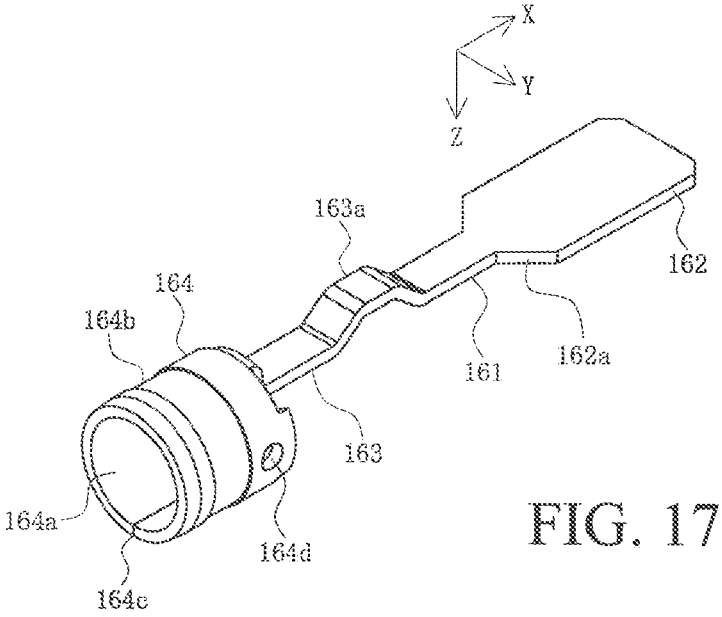
Figure 17B:
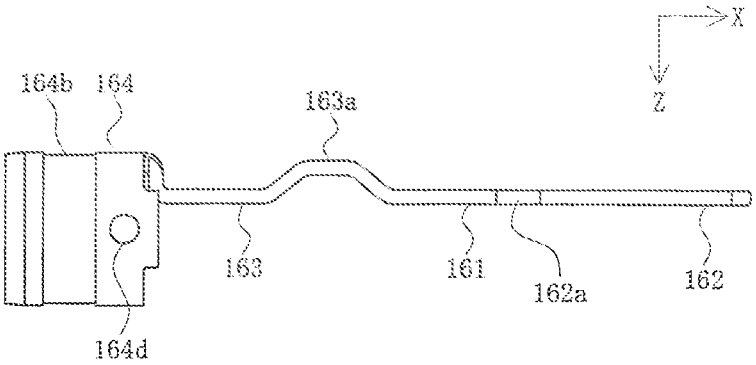

As shown in FIGS. 17A and 17B, the mating shell 161 includes a flat plate-like main body portion 163 extending in the front-rear direction (X-axis direction), a flat plate-like tail portion 162 extending rearward (X-axis positive direction) extending from the rear end of the main body portion 163, and a cylindrical contact portion 164 connected to the front end of the main body portion 163. The tail portion 162 is a flat plate-like member wider than the main body portion 163, and is connected to a connector, a circuit board, and a conductive line such as an electric wire which are included in equipment (not shown) on which the mating connector 101 is mounted. In addition, inclined portions 162*a* are formed on both sides in a width direction so that the shift to the main body portion 163 having a narrow width is smoothly made at the front end of the tail portion 162.

In addition, the contact portion 164 is a portion manufactured by rolling a flat plate-like metal plate into a cylindrical shape, and includes a seam 164*c* extending in the front-rear direction (X-axis direction). The inside of the contact portion 164 is a columnar internal cavity 164*a* through which the contact portion 154 of the mating terminal 151 passes. In addition, the outer circumferential surface of the contact portion 164 is provided with the recessed portion 164*b* extending over the whole circumference in the circumferential direction. The recessed portion 164*b* is engaged with the lock protrusion 64 of the shell 61 which is included in the connector 1 fitted into the mating connector 101. In addition, the vicinity of the rear end of the contact portion 164 is provided with an opening 164*d* penetrating through the metal plate constituting the contact portion 164 in the thickness direction. A part of the insulating material forming the mating housing 111 enters the opening 164*d*.

A curved portion 163*a* having a substantially crank-like side surface shape is formed in the middle of the main body portion 163. As shown in FIG. 17B, a portion other than the curved portion 163*a* and the tail portion 162 of the main body portion 163 are biased upward (in the example shown in the drawing, the Z-axis negative direction) from the cylindrical central axis of the contact portion 164 to linearly extend in the front-rear direction. As shown in FIG. 13B, the main body portion 153 of the mating terminal 151 is biased in a direction (in the example shown in the drawing, Z-axis positive direction) opposite to the main body portion 163 and the tail portion 162 across the central axis to linearly extend in the front-rear direction. The curved portion 163*a* is biased more greatly than the portion other than the curved portion 163*a* and the tail portion 162 in the main body portion 163. Therefore, since the distance between the curved portion 163*a* and the main body portion 153 of the mating terminal 151 is increased, when the mating housing 111 is molded by the overmold molding, the insulating material filled in the molding mold (not shown) smoothly flows through the gap between the curved portion 163*a* and the main body portion 153 of the mating terminal 151 to be uniformly filled in the whole of the molding mold.

As shown in FIGS. 13A and 13B, the gate formed on the wall surface of the molding mold (mold) (not shown) is positioned between the curved portion 163*a* of the main body portion 163 of the mating shell 161 and the main body portion 153 of the mating terminal 151, and the insulating material forming the mating housing 111 is filled in the molding mold as shown by the arrow 44 through the gate and enters each portion to integrate the portions. The thickness of the main body portion 163 of the mating shell 161 is thinner than the main body portion 153 of the mating terminal 151, and the thinner side of the plate thickness is provided with the curved portion 163*a* to escape from the flow of the insulating material. As a result, it possible to prevent the deformation of the mating shell 161 and the mating terminal 151 due to the flow of the insulating material during the overmold molding.

As shown in FIGS. 16A and 16B, the mating terminal 151 includes the flat plate-like main body portion 153 extending in the front-rear direction (X-axis direction), the flat plate-like tail portion 152 extending rearward (X-axis positive direction) from the rear end of the main body portion 153, and the columnar contact portion 154 connected to the front end of the main body portion 153. The tail portion 152 is a flat plate-like member wider than the main body portion 153, and is connected to a connector, a circuit board, and a conductive line such as an electric wire which are included in equipment (not shown) on which the mating connector 101 is mounted. Then, the contact portion 154 enters between the mutually opposing contact arm portions 54 of the terminal 51 of the connector 1 fitted into the mating connector 101, and is sandwiched from both sides thereof. As a result, the contact between the contact portion 154 of the mating terminal 151 and the contact arm portion 54 of the terminal 51 is reliably maintained, and the contact portion 154 of the mating terminal 151 and the contact arm portion 54 of the terminal 51 are reliably conducted to each other. In addition, the inclined portions 152*a* are formed on both sides in a width direction so that the shift to the main body portion 153 having a narrow width is smoothly made at the front end of the tail portion 152.

In addition, the vicinity of the front end of the main body portion 153 is provided with a stepped portion 153*a* having a substantially step-like side surface shape. As shown in FIG. 13B, a portion and the contact portion 154 in front of the stepped portion 153*a* (X-axis negative direction) in the main body portion 153 linearly extend with substantially coinciding with the cylindrical central axis of the contact portion 164 of the mating shell 161, but a portion and the tail portion 152 behind (X-axis positive direction) the stepped portion 153*a* in the main body portion 153 linearly extend in the front-rear direction with being biased downward (in the example shown in the drawing, the Z-axis positive direction) from the central axis. As described above, the main body portion 153 and the tail portion 152 are biased toward the direction opposite to the main body portion 163 and the tail portion 162 of the mating shell 161 across the central axis, such that the main body portion 163 and the tail portion 162 of the mating shell 161 does not contact each other.

In the state in which the mating shell 161 and the mating terminal 151 are arranged so as to have a positional relationship as shown in FIGS. 13B and 14B, to surround the circumferences of the connection portion between the main body portion 163 and the tail portion 162 of the mating shell 161 and the connection portion between the main body portion 153 and the tail portion 152 of the mating terminal 151, the mating seal member 131 is integrally attached by the overmold molding. The elastomer forming the mating seal member 131 which is a material having higher flexibility than that of the material of the mating housing 111 seals the gap between the mating shell 161 and the mating terminal 151 and the circumference thereof in the watertight manner.

Subsequently, the mating housing 111 is integrally attached by the overmold molding so as to cover the circumferences of the mating shell 161, the mating terminal 151, and the mating seal member 131. As shown in FIGS. 13A-15D, the mating housing 111 covers the circumference of the mating seal member 131 and keeps the elastomer forming the mating seal member 131 confined therein. At this time, since the inclined portion 162*a* formed at the connection portion between the main body portion 163 and the tail portion 162 of the mating shell 161 and the inclined portion 152*a* formed at the connection portion between the main body portion 153 and the tail portion 152 of the mating terminal 151 support the elastomer, even when the elastomer which is a material having high flexibility is pushed by the flow of the insulating material when the mating housing 111 is over-molded or is pressed from the circumference by the insulating material forming the same, the circumferences of the connection portion between the main body portion 163 and the tail portion 162 in the mating shell 161 and the main body portion 153 and the tail portion 152 in the mating terminal 151 can be kept surrounded without the elastomer flowing out.

It is not always necessary to form the inclined portions 152*a* and 162*a* on the tail portion 152 of the mating terminal 151 and the tail portion 162 of the mating shell 161, and as shown in FIGS. 15C and 15D, if the mating seal member 131 is disposed to be caught in the vicinity in front of the tail portions 152 and 162, even when the inclined portions 152*a* and 162*a* are omitted, the same operation and effect can be obtained. That is, it is preferable that the mating seal member 131 surrounds the connection portion between the main body portion 153 and the tail portion 152 of the mating terminal 151 and the connection portion between the main body portion 163 and the tail portion 162 in the mating shell 161.

In addition, as shown FIGS. 12A-15D, the mating housing 111 covers the whole of the main body portion 153 of the mating terminal 151 and the whole of the contact portion 164 and the main body portion 163 of the mating shell 161 in the front-rear direction, and a range having a predetermined length from the tip of the contact portion 154 of the mating terminal 151 is exposed forward (X-axis negative direction) from a housing front end 111*f* to protrude, and a range having a predetermined length from the rear ends of the tail portion 162 of the mating shell 161 and the tail portion 152 of the mating terminal 151 is exposed rearward (X-axis positive direction) from a housing rear end 111*r* to protrude. It is preferable that a plate-like interposing portion 111*b* interposed between the tail portion 162 of the mating shell 161 and the tail portion 152 of the mating terminal 151 is formed behind the housing rear end 111*r*. In addition, the mating housing 111 is formed so that at least a part of the cylindrical outer circumferential surface of the contact portion 164 of the mating shell 161 is exposed at a portion close to the housing front end 111*f*. Since a part of the insulating material forming the mating housing 111 enters the opening 164*d* formed in the contact portion 164, the contact portion 164 is reliably attached to the mating housing 111.

In addition, a flange portion 111*a* protruding outward in the radial direction is formed on the outer circumferential surface of the mating housing 111 near the middle between the housing front end 111*f* and the housing rear end 111*r* in the front-rear direction. The flange portion 111*a* is a portion to be attached to an outer wall of a casing of equipment (not shown) on which the mating connector 101 is mounted, and a portion of the mating connector 101 in front of the flange portion 111*a* in the mating connector 101 is exposed to the outside of the casing, and a portion of the mating connector 101 behind the flange portion 11*a* in the mating connector 101 is housed inside the casing. In addition, a first concave groove portion 111*c* is formed in a portion in front of the flange portion 111*a* over the whole circumference of the outer circumferential surface of the mating housing 111, and a second concave groove portion 111*d* is formed in a portion behind the flange portion 111*a* on the whole circumference thereof. The first outer seal member 141 is attached to the first concave groove portion 111*c* and the second outer seal member 142 is attached to the second concave groove portion 111*d*. The first outer seal member 141 and the second outer seal member 142 protrude outward in the radial direction from the outer circumferential surface of the mating connector 101 at the front and rear thereof.

In addition, a third concave groove portion 111*e* is formed in a portion behind the second concave groove portion 111*d* on the whole circumference of the outer circumference surface of the mating housing 111. When the mating housing 111 is press-fitted into the hole formed on the outer wall of the casing, the third concave groove portion 111*e* is a groove for accommodating chips or the like in the case in which the chips or the like occur due to a friction of the mating housing 111 behind the third concave groove portion 111*e* with the hole. Since the chips or the like are accommodated in the third concave groove portion 111*e*, it is possible to prevent a decrease in waterproof property due to the adhesion of the chips or the like to the second outer seal member 142. When the mating housing 111 is not fitted into the connector 1, water is prevented from infiltrating into the casing by the mating seal member 131 and the second outside seal member 142.

Next, the state in which the connector 1 having the above-described configuration is fitted into the mating connector 101 will be described.

Figure 18A:
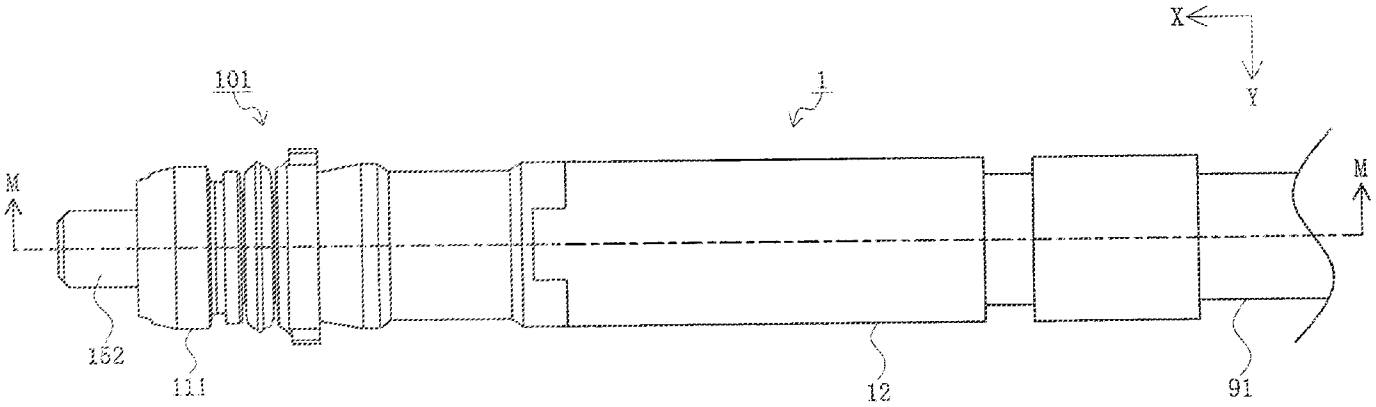
Figure 18B:
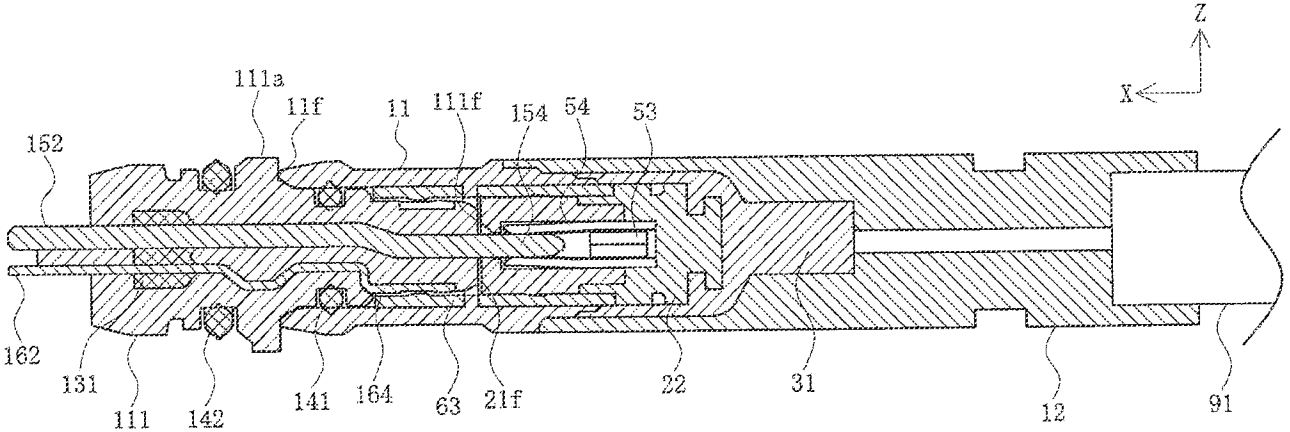
Figure 19:
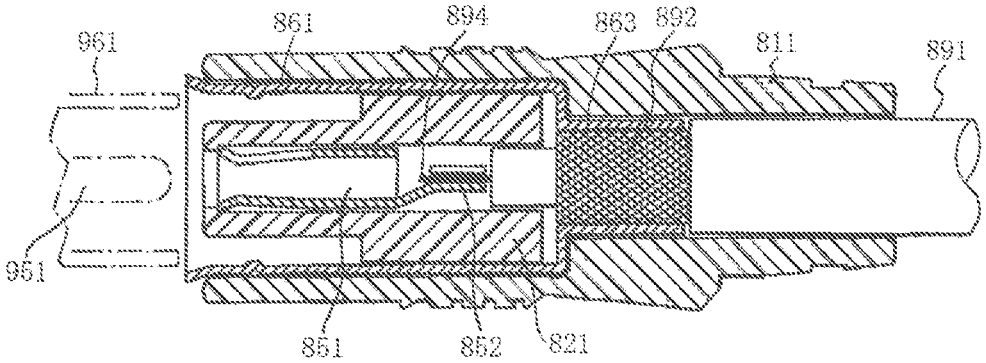
FIG. 19 Prior Art
FIG. 19 is a cross-sectional view of the conventional connector.

FIGS. 18A and 18B are two-side views showing the state in which the connector and the mating connector according to the present embodiment are fitted into each other, in which FIG. 18A is a top view and FIG. 18B is a cross-sectional view taken along the arrow M-M in FIG. 18A.

In the present embodiment, the connector 1 and the mating connector 101 are relatively close to each other from a state in which a housing front end 11*f* and the housing front end 111*f* of the mating housing 111 are separated from each other facing each other to the front sleeve 11, and the housing front end 111*f* of the mating housing 111 relatively enters the internal cavity 11*a* opened in the housing front end 11*f* of the front sleeve 11 so that the housing front end 111*f* of the mating housing 111 and the internal cavity 11*a* are fitted into each other as shown in FIGS. 18A and 18B.

When the connector 1 and the mating connector 101 are fitted into each other, a portion in front of the flange portion 111*a* of the mating housing 111 enters the internal cavity 11*a* of the front sleeve 11 to be housed in the internal cavity 11*a*, the contact portion 164 of the mating shell 161 exposed to the portion of the front enters the internal cavity 61*a* of the shell 61 to be housed in the internal cavity 61*a*, the flange portion 111*a* of the mating housing 111 is close to or abuts against the housing front end 11*f* of the front sleeve 11, the housing front end 111*f* of the mating housing 111 is close to or abuts against the front end 21*f* of the intermediate insulator 21, and the contact portion 154 of the mating terminal 151 enters the internal cavity 21*a* opened in the front end 21*f* of the intermediate insulator 21 and enters between the pair of contact arm portions 54 of the terminal 51 housed in the internal cavity 21*a* and is sandwiched from both sides thereof.

In addition, the vicinity of the housing front end 111*f* of the mating housing 111 and the vicinity of the front end 21*f* of the intermediate insulator 21 are substantially the same diameter, and are arranged in parallel with the connector 1 and the mating connector 101 in the insertion/extraction direction (X-axis direction). Similarly, the contact portion 164 of the mating shell 161 is also arranged in parallel with the intermediate insulator 21 and the terminal 51 in the insertion/extraction direction. In addition, the member of the mating connector 101 that enters the rear (X-axis negative direction) from the slit 63*a* of the shell 61 is only the contact portion 154 of the mating terminal 151, and the mating housing 111 or the mating shell 161 does not enter further backward than the slit 63*a*. In addition, even if the connector 1 and the mating connector 101 are twisted while being fitted into each other or the cable 91 is pulled obliquely, since a portion in front of (X-axis positive direction) the slit 63*a* of the shell 61 is flexibly displaced to correspond thereto, such that even if the fitting between the connector 1 and the mating connector 101 is released, the connector 1 or the mating connector 101 will not be damaged. Therefore, it is possible to reduce the diameters of the connector 1 and the mating connector 101, and it is possible to obtain a connector assembly which is not easily damaged while maintaining the insertion/extraction performance (fitting feeling, inserting power, withdrawal force of tension and the like) and contactability of the connector 1 and the mating connector 101.

In addition, since the tapered portion 21*a*1 is formed in the internal cavity 21*a* of the intermediate insulator 21, the tip of the mating terminal 151 can smoothly enter the internal cavity 21*a*. In addition, since the distance between the contact arm portions 54 at the free end is smaller than the outer diameter of the mating terminal 151, the pair of contact arm portions 54 facing each other generate a repulsive fore as a spring to sandwich the mating terminal 151 from both sides if the mating terminal 151 enters therebetween to be widened. As a result, the contact between the contact arm portion 54 and the mating terminal 151 is reliably maintained, and reliably conducted to each other. In addition, the plurality of lock protrusions 64 formed on the main body portion 63 of the shell 61 are engaged with the concave portion 164*b* formed in the contact portion 164 of the mating shell 161. As a result, the contact between the main body portion 63 of the shell 61 and the contact portion 164 of the mating shell 161 are reliably maintained, and reliably conducted to each other. In addition, the first outer seal member 141 attached to the first concave groove portion 111*c* of the mating housing 111 is pressed against the inner circumferential surface of the internal cavity 11*a* of the front sleeve 11. As a result, the space between the outer circumferential surface of the mating housing 111 and the inner circumferential surface of the internal cavity 11*a* of the front sleeve 11 is sealed in a watertight manner to prevent the infiltration of moisture.

Even if moisture passes through a location sealed by the first outer seal member 141 to infiltrate thereinto, in the connector 1, since the tail portion 52 of the terminal 51 and the tail portion 62 of the shell 61 and the circumference of the core wire 94 of the cable 91 connected thereto are covered by the seal member 31, the infiltration of moisture into the tail portion 52 of the terminal 51, the tail portion 62 of the shell 61, and the core wire 94 is reliably prevented. Similarly, in the mating connector 101, since the mating seal member 131 covers an area between the mating seal 161 and the mating terminal 151 and the circumference thereof, the infiltration of moisture into the tail portion 152 of the mating terminal 151 and the tail portion 162 of the mating shell 161 is reliably prevented.

As described above, in the present embodiment, the connector 1 includes the hollow main body portion 63, the shell 61 including the opening 63*b* penetrating the side wall of the main body portion 63, the intermediate insulator 21 which is made of the insulating material, housed in the main body portion 63, and includes the internal cavity 21*a* formed in the intermediate insulator 21 and the recessed portion 21*b* recessed from the outer circumferential surface of the intermediate insulator 21, the main body portion 53 which is housed in the internal cavity 21*a*, the terminal 51 which includes the contact arm portion 54 extending forward from the main body portion 53 and housed in the internal cavity 21*a*, and the cap 22 which is made of the insulating material and integrally attached to the rear end of the main body portion 63 of the shell 61 and the rear end of the main body portion 53 of the terminal 51, wherein the cap 22 includes the protruding portion 22*b* entering the opening 63*b* of the shell and the cylindrical portion 22*c* entering the recessed portion 21*b* of the intermediate insulator 21 positioned in the internal cavity 61*a* of the main body portion 63 of the shell 61.

As described above, in the present embodiment, the connector includes the outer conductor portion 61 which includes the hollow outer body portion 63, the intermediate insulator 21 which is made of the insulating material and housed in the outer body portion 63, and includes the internal cavity 21*a* formed in the intermediate insulator 21, the central body portion 53 which is housed in the internal cavity 21*a*, the central conductor portion 54 which includes the contact arm portion 54 extending forward from the central body portion 53 and is housed in the internal cavity 21*a*, the cap 22 which is made of the insulating material and integrally attached to the rear end of the outer body portion 63 and the rear end of the central body portion 53, the seal member 31 which is made of the elastomer and integrally attached to the rear end of the cap 22, and the rear sleeve 12 which is made of the insulating material and integrally attached to the outside of the seal member 31.

As described above, in the present embodiment, the connector 1 includes the outer conductor portion 61 which includes the hollow outer body portion 63, the seam 63*c* formed in the outer body portion 63 and extending in the front-rear direction, and the slit 63*a* extending in the circumferential direction to be caught in the seam 63*c*, the intermediate insulator 21 which is made of the insulating material, has at least a part thereof behind the slit 63*a* housed in the outer body portion 63, and includes the internal cavity 21*a* formed in the intermediate insulator 21, and the central conductor portion 53 which includes the central body portion 53 housed in the internal cavity 21*a* and the contact arm portion 54 extending forward from the central body portion 53 and housed in the internal cavity 21*a*.

As described above, in the present embodiment, the mating connector 101 includes the mating housing 111 which is made of the insulating material, the mating outer conductor portion 161 which includes the main body portion 163 buried into the mating housing 111 and the contact portion 164 connected to the main body portion 163 and having at least a part of the outer circumferential surface exposed from the mating housing 111, and the mating central conductor portion 151 which includes the main body portion 153 buried into the mating housing 111 and is connected to the main body portion 153 and has at least a tip thereof protruding forward from the housing front end 111*f* of the mating housing 111, in which the main body portion 163 of the mating outer conductor portion 161 includes the curved portion 163*a* having a substantially crank-like side surface shape.

As a result, it is possible to obtain the highly reliable connector 1 having the high waterproof property and insertion/extraction property while being small in size.

In addition, the connector further includes the seal member 31 which is made of the elastomer and integrally attached to the rear end of the cap 22 and the front sleeve 11 which is made of the insulating material and integrally attached to the outer side of the main body portion 63 of the shell 61, wherein the seal member 31 is formed such that the front side of the seal member 31 overlaps the rear end of the outer circumferential surface of the front sleeve 11 and the vicinity of the rear end of the front sleeve 11. In addition, the rear side of the cap 22 is provided with the anchor portion 22*a* having the constricted portion 22*f*, and the seal member 31 is formed such that the rear portion of the seal member 31 covers the circumference of each member in the range up to at least the anchor portion 22*a*. In addition, the shell 61 includes the tail portion 62 extending rearward from the main body portion 63, the terminal 51 includes the tail portion 52 extending rearward from the main body portion 53, the cable 91 is connected to the outer tail portion 62 and the central tail portion 52, and the seal member 31 is formed to cover the circumference of each member in the range up to the portion close to the front end on the outer circumferential surface of the inner covering member 95 of the electric wire 93 of the cable 91 without gaps. In addition, the tail portion 62 of the shell 61 includes the first connection plate 62*a* and the second connection plate 62*b* which are orthogonal to each other as viewed from the front-rear direction and connected to two locations, respectively, on the circumferential surface of the second core wire 94*b* of the cable 91 extending in the front-rear direction, the tail portion 52 of the terminal 51 includes the first connection plate 52*a* and the second connection plate 52*b* which are orthogonal to each other as viewed from the front-rear direction and two locations, respectively, on the circumferential surface of the first core wire 94*a* of the cable 91 extending in the front-rear direction, wherein the first connection plate 62*a* of the shell 61 and the first connection plate 52*a* of the terminal 51 face each other and the second connection plate 62*b* of the shell 61 and the second connection plate 52*b* of the terminal 51 are disposed so as to be substantially flush with each other. Therefore, it is possible to easily and reliably connect the first core wire 94*a* and the second core wire 94*b* of the cable 91 to the tail portion 62 of the shell 61 and the tail portion 52 of the terminal 51.

In addition, the outer conductor portion 61 includes the outer tail portion 62 extending rearward from the outer body portion 63, the central conductor portion 51 includes the central tail portion 52 extending rearward from the central body portion 53, the electric wire 93 of the cable 91 is connected to the outer tail portion 62 and the central tail portion 52, the electric wire 93 is covered with the outer covering member 92, the rear sleeve 12 includes the gate trace 12*c* which is positioned in front of the front end portion of the outer covering member 92 and is formed at the position corresponding the gate through which the insulating material of the rear sleeve 12 flows in the molding mode. In addition, the rear sleeve 12 includes the recessed portion 12*b* existing over the whole circumference of the outer surface in front of the gate trace 12*c*. The rear sleeve 12 includes the overflow trace 12*d* which is positioned close to the rear end 12*r* on the outer surface and formed at the position at which the insulating material of the rear sleeve 12 flows out from the inside of the molding mold by the overflow. The connector 1 further includes the front sleeve 11 which is made of the insulating material and integrally attached to the outside of the outer body portion 63 in front of the rear sleeve 12. Therefore, it is possible to easily and reliably connect the first core wire 94*a* and the second core wire 94*b* of the cable 91 to the tail portion 62 of the shell 61 and the tail portion 52 of the terminal 51.

In addition, the intermediate insulator 21 is fixed to the outer conductor portion 61 behind the slit 63*a*. The connector further includes the front sleeve 11 which is made of the insulating material, is integrally attached to the outside of the outer body portion 63, and has a part thereof entering into the slit 63*a*. The connector further includes the cap 22 which is made of the insulating material and integrally attached to the rear end of the outer body portion 63 and the rear end of the central body portion 53, in which the outer conductor portion 61 includes the opening 63*b* penetrating through the side wall of the outer body portion 63, the intermediate insulator 21 includes the recessed portion 21*b* recessed from the outer circumferential surface, and the cap 22 includes the protruding portion 22*b* entering the opening 63*b* of the outer conductor portion 61 and the cylindrical portion 22*c* entering between the outer body portion 63 and the recessed portion 21*b* of the intermediate insulator 21.

In addition, the mating connector further includes: the mating seal member 131 which is made of the insulating material, in which the mating outer conductor portion 161 includes the tail portion 162 extending rearward from the main body portion 163, and the mating central conductor portion 151 includes the tail portion 152 extending rearward from the main body portion 153, and the mating seal member 131 is integrally molded within the mating housing 111 to surround a circumference of a connection portion between the main body portion 163 and the tail portion 162 of the mating outer conductor portion 161 and a circumference of a connection portion between the main body portion 153 and the tail portion 152 of the mating central conductor portion 151. The inclined portion 162*a* shifted to the main body portion 163 having a narrow width is formed on both sides in a width direction at a front end of the tail portion 162 as the connection portion of the mating outer conductor portion 161, the inclined portion 152*a* shifted to the main body portion 153 having a narrow width is formed on both sides in a width direction at a front end of the tail portion 152 as the connection portion of the mating central conductor portion 151, and the seal member is integrally formed to surround a circumference of the inclined portion The main body portion 163 of the mating outer conductor portion 161 and the main body portion 153 of the mating central conductor portion 151 are formed in a plate shape and are disposed in parallel with each other, and a thickness of the main body portion 163 of the mating outer conductor portion 161 is thinner than that of the main body portion 153 of the mating central conductor portion 151.

It should be noted that the present disclosure is merely an example, and appropriate changes that keep the gist of the present disclosure and can be conceived by those skilled in the art are included in the scope of the present disclosure. The widths, thicknesses, shapes, or the like of the respective portions shown in the drawings are schematically shown and do not limit the interpretation of the present disclosure.

In addition, the disclosure herein describes features related to preferred and exemplary embodiments. Those skilled in the art can naturally understand various other embodiments, modifications and variations within the scope and spirit of the claims appended hereto by reviewing the disclosure of the present specification.

The present disclosure can be applied to a connector and a connector assembly.

The invention claimed is:

1. A connector comprising:

(a) an outer conductor portion which includes a hollow outer body portion and an opening penetrating through a side wall of the outer body portion;

(b) an intermediate insulator which is made of an insulating material and housed in the outer body portion, and includes an internal cavity formed in the intermediate insulator and a recessed portion further recessed than an outer circumferential surface of the intermediate insulator;

(c) a central conductor portion which includes a central body portion housed in the internal cavity and a contact arm portion extending forward from the central body portion and housed in the internal cavity; and (d) a cap which is made of an insulating material and integrally attached to a rear end of the outer body portion and a rear end of the central body portion, (e) wherein the cap includes a protruding portion entering an opening of the outer conductor portion and a cylindrical portion entering the recessed portion of the intermediate insulator positioned at the internal cavity of the outer body portion.

2. The connector according to claim 1, further comprising:

a seal member which is made of an elastomer and integrally attached to a rear end of the cap; and a front sleeve which is made of an insulating material and integrally attached to an outer side of the outer body portion, wherein the seal member is formed such that a front side of the seal member overlaps a rear end on an outer circumferential surface of the front sleeve and a vicinity of the rear end of the front sleeve.

3. The connector according to claim 2, wherein the cap is formed with an anchor portion having a constricted portion provided behind the cap, and the seal member is formed such that a rear side of the seal member covers a circumference of the cap in a range up to the at least anchor portion.

4. The connector according to claim 2, wherein the outer conductor portion includes an outer tail portion extending rearward from the outer body portion, the central conductor portion includes a central tail portion extending rearward from the central body portion, a cable is connected to the outer tail portion and the central tail portion, and the seal member is formed so as to cover the circumference of each member without a gap in a range up to a portion close to a front end on an outer circumferential surface of an inner covering member of an electric wire of the cable.

5. The connector according to claim 4, wherein the outer tail portion includes a first connection plate and a second connection plate which are orthogonal to each other as viewed from a front-rear direction and are each connected to two locations on a circumferential surface of a second core wire of a cable extending in the front-rear direction, the central tail portion includes a first connection plate and a second connection plate which are orthogonal to each other as viewed from a front-rear direction and are each connected to two locations on a circumferential surface of a first core wire of the cable extending in the front-rear direction, the first connection plate of the outer tail portion and the first connection plate of the central tail portion face each other, and the second connection plate of the outer tail portion and the second connection plate of the central tail portion are disposed so as to be substantially flush with each other.

6. A connector comprising:

(a) an outer conductor portion which includes a hollow outer body portion;

(b) an intermediate insulator which is made of an insulating material and housed in the outer body portion, and includes an internal cavity formed in the intermediate insulator;

(c) a central conductor portion which includes a central body portion housed in the internal cavity and a contact arm portion extending forward from the central body portion and housed in the internal cavity;

(d) a cap which is made of an insulating material and integrally attached to a rear end of the outer body portion and a rear end of the central body portion;

(e) a seal member which is made of an elastomer and integrally attached to a rear end of the cap; and (f) a rear sleeve which is made of an insulating material and integrally attached to an outer side of the seal member.

7. The connector according to claim 6, wherein the outer conductor portion includes an outer tail portion extending rearward from the outer body portion, the central conductor portion includes a central tail portion extending rearward from the central body portion, an electric wire of a cable is connected to the outer tail portion and the central tail portion, the electric wire is covered with an outer covering member, and the rear sleeve includes a gate trace which is positioned in front of a front end of the outer covering member and formed at a position corresponding to a gate through which an insulating material of the rear sleeve flows into a molding mold.

8. The connector according to claim 7, wherein the rear sleeve includes a recessed portion existing over a whole circumference of an outer surface in front of the gate trace.

9. The connector according to claim 6, wherein the rear sleeve includes an overflow trace which is positioned near a rear end on an outer surface of the rear sleeve and is formed at a position at which the insulating material of the rear sleeve is discharged from an inside of the molding mold by an overflow.

10. The connector according to claim 6, further comprising: a front sleeve which is made of an insulating material and integrally attached to an outer side of the outer body portion in front of the rear sleeve.

11. A connector comprising:

(a) an outer conductor portion which includes a hollow outer body portion, a seam formed in the outer body portion and extending in a front-rear direction, and a slit extending in a circumferential direction to be caught in the seam;

(b) an intermediate insulator which is made of an insulating material and has at least a part thereof behind the slit housed in the outer body portion, and includes an internal cavity formed in the intermediate insulator; and (c) a central conductor portion which includes a central body portion housed in the internal cavity and a contact arm portion extending forward from the central body portion and housed in the internal cavity.

12. The connector according to claim 11, wherein the intermediate insulator is fixed to the outer conductor portion behind the slit.

13. The connector according to claim 11, further comprising: a front sleeve which is made of an insulating material, is integrally attached to an outside of the outer body portion, and has a part thereof entering into the slit.

14. The connector according to claim 11, further comprising: a cap which is made of an insulating material and integrally attached to a rear end of the outer body portion and a rear end of the central body portion, wherein the outer conductor portion includes an opening penetrating through a side wall of the outer body portion, the intermediate insulator includes a recessed portion recessed from an outer circumferential surface thereof, and the cap includes a protruding portion entering the opening of the outer conductor portion and a cylindrical portion entering between the outer body portion and the recessed portion of the intermediate insulator.

15. A connector assembly comprising: the connector according to claim 11, a mating outer conductor connected to the outer conductor portion, and a mating connector including a mating central conductor connected to the central conductor portion.

16. A mating connector comprising:

(a) a mating housing which is made of an insulating material;

(b) a mating outer conductor portion which includes a main body portion buried into the mating housing and a contact portion connected to the main body portion and having at least a part of an outer circumferential surface exposed from the mating housing;

(c) a mating central conductor portion which includes a main body portion buried into the mating housing and is connected to the main body portion of the mating outer conductor portion and has at least a tip thereof protruding forward from a housing front end of the mating housing; and (d) a mating seal member which is made of an insulating material, (e) wherein the main body portion of the mating outer conductor portion includes a curved portion having a substantially crank-like side surface shape, (f) wherein the mating outer conductor portion includes a tail portion extending rearward from the main body portion, and the mating central conductor portion includes a tail portion extending rearward from the main body portion, and (g) wherein the mating seal member is integrally molded within the mating housing to surround a circumference of a connection portion between the main body portion and the tail portion of the mating outer conductor portion and a circumference of a connection portion between the main body portion and the tail portion of the mating central conductor portion.

17. The mating connector according to claim 16, wherein an inclined portion shifted to the main body portion having a narrow width is formed on both sides in a width direction at a front end of the tail portion as the connection portion of the mating outer conductor portion, an inclined portion shifted to the main body portion having a narrow width is formed on both sides in a width direction at a front end of the tail portion as the connection portion of the mating central conductor portion, and the seal member is integrally formed to surround a circumference of the inclined portion.

18. The mating connector according to claim 16, wherein the main body portion of the mating outer conductor portion and the main body portion of the mating central conductor portion are each formed in a plate shape and are disposed in parallel with each other, and a thickness of the main body portion of the mating outer conductor portion is thinner than that of the main body portion of the mating central conductor portion.

19. A connector assembly comprising: the mating connector according to claim 16, an outer conductor portion which is connected to the mating outer conductor portion, and a central conductor portion which is connected to the mating central conductor portion.

* * * * *